US011230107B2

(12) United States Patent
Studer et al.

(10) Patent No.: US 11,230,107 B2
(45) Date of Patent: Jan. 25, 2022

(54) HORIZONTAL INTERFACE FOR FLUID SUPPLY CARTRIDGE HAVING DIGITAL FLUID LEVEL SENSOR

(71) Applicant: Hewlett-Packard Development Company, L.P., Spring, TX (US)

(72) Inventors: Anthony D. Studer, Corvallis, OR (US); David C. Harvey, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 509 days.

(21) Appl. No.: 16/316,317

(22) PCT Filed: Jul. 27, 2016

(86) PCT No.: PCT/US2016/044251
§ 371 (c)(1),
(2) Date: Jan. 8, 2019

(87) PCT Pub. No.: WO2018/022038
PCT Pub. Date: Feb. 1, 2018

(65) Prior Publication Data
US 2021/0276337 A1 Sep. 9, 2021

(51) Int. Cl.
*B41J 2/175* (2006.01)

(52) U.S. Cl.
CPC ..... *B41J 2/17513* (2013.01); *B41J 2/1752* (2013.01); *B41J 2/17566* (2013.01)

(58) Field of Classification Search
CPC ... B41J 2/17513; B41J 2/1752; B41J 2/17566
USPC ..... 347/7
See application file for complete search history.

(56) References Cited

U.S. PATENT DOCUMENTS

| | | | | |
|---|---|---|---|---|
| 5,435,657 | A | 7/1995 | Pearce et al. | |
| 5,788,388 | A | 8/1998 | Cowger et al. | |
| 7,059,696 | B2 | 6/2006 | Eguchi et al. | |
| 7,311,389 | B1 | 12/2007 | Pidgeon | |
| 7,552,999 | B2 | 6/2009 | Wanibe et al. | |
| 9,227,416 | B2 | 1/2016 | Otobe | |
| 9,855,318 | B2 | 1/2018 | Baldwin et al. | |
| 2004/0027432 | A1* | 2/2004 | Childers | B41J 2/17513 347/86 |
| 2005/0219335 | A1 | 10/2005 | Silverbrook et al. | |

(Continued)

FOREIGN PATENT DOCUMENTS

| | | |
|---|---|---|
| CN | 1400101 | 3/2003 |
| CN | 1840346 | 10/2006 |

(Continued)

*Primary Examiner* — Kristal Feggins
*Assistant Examiner* — Alexander D Shenderov
(74) *Attorney, Agent, or Firm* — Michael Dryja

(57) ABSTRACT

A horizontal interface for a fluid supply cartridge is to connect the fluid supply cartridge to a fluid-ejection device. The horizontal interface includes one or more fluidic interconnect septums to horizontally fluidically interconnect a supply of fluid of the fluid supply cartridge to the fluid-ejection device. The horizontal interface includes an electrical interface to horizontally conductively connect a digital fluid level sensor of the fluid supply cartridge to a corresponding electrical interface of the fluid-ejection device.

15 Claims, 12 Drawing Sheets

(56) References Cited

U.S. PATENT DOCUMENTS

| | | | | |
|---|---|---|---|---|
| 2006/0250446 | A1 | 11/2006 | Wanibe et al. | |
| 2011/0128330 | A1 | 6/2011 | Chen et al. | |
| 2012/0044304 | A1* | 2/2012 | Koizumi ..... | B41J 2/1752 347/85 |
| 2014/0260520 | A1 | 9/2014 | Schoenberg | |

FOREIGN PATENT DOCUMENTS

| | | | |
|---|---|---|---|
| CN | 102896902 | | 1/2013 |
| CN | 104085197 | | 10/2014 |
| CN | 105984229 | | 10/2016 |
| EP | 0994779 | A1 | 4/2000 |
| EP | 1281523 | A2 | 2/2003 |
| EP | 1863645 | A1 | 12/2007 |
| EP | 2103434 | A1 | 9/2009 |
| EP | 2982514 | A1 | 2/2016 |
| GB | 2321220 | | 7/1998 |
| JP | 02018056 | | 1/1990 |
| JP | 06286160 | | 10/1994 |
| JP | 10315495 | | 2/1998 |
| JP | 2002513340 | | 5/2002 |
| JP | 2003152297 | | 5/2003 |
| JP | 2008087159 | | 4/2008 |
| JP | 2011224854 | | 11/2011 |
| JP | 2012091508 | | 5/2012 |
| JP | 2013536768 | | 9/2013 |
| KR | 20060027903 | | 3/2003 |
| WO | 2007037449 | | 4/2007 |

* cited by examiner

HORIZONTAL INTERFACE FOR FLUID SUPPLY CARTRIDGE HAVING DIGITAL FLUID LEVEL SENSOR

BACKGROUND

Fluid-ejection devices include inkjet-printing devices, such as inkjet printers, which can form images on media like paper by selectively ejecting ink onto the media. Many types of fluid-ejection devices are receptive to the insertion or connection of fluid supply cartridges, such as ink cartridges in the case of inkjet-printing devices. When the supply of fluid within an existing cartridge has been exhausted, the cartridge can be removed from a fluid-ejection device in which the cartridge has been inserted, and a new cartridge containing a fresh fluid supply then inserted into or connected to the fluid-ejection device so that the device can continue to eject fluid.

DETAILED DESCRIPTION

As noted in the background section, fluid-ejection devices like inkjet-printing devices are receptive to the insertion or connection of fluid supply cartridges like ink cartridges. Such removable cartridges permit fresh supplies of fluid to be provided to a fluid-ejection device when an existing supply has been exhausted, for instance. Some types of fluid supply cartridges include fluid level sensors that can measure the level (i.e., the amount) of fluid remaining therein.

One type of fluid level sensor is a digital fluid level sensor, which relies upon silicon slivers within the sensor and against which fluid of a cartridge comes into contact. As the level of fluid within the cartridge decreases, the exposed areas of such slivers against which the fluid makes contact also decreases. The level of fluid may be determinable via a difference in cooling rate of the sliver sensors (i.e., the exposed areas of the slivers) in aggregate, because the cooling rate differs depending on which exposed areas of the slivers are in contact with fluid and which exposed areas of the slivers are not in contact with fluid but rather are in contact with ambient air within the cartridge. An example of such an innovative fluid level sensor is described at the end of the detailed description.

Disclosed herein are novel horizontal interfaces for fluid supply cartridges that have digital fluid level sensors. The interface is a horizontal interface in that a fluid supply cartridge of which the interface can be a part is horizontally insertable into a fluid-ejection device, such as from left to right or from right to left and perpendicular to a gravitational direction, instead of vertically insertable into the device. The interface includes one or more fluidic interconnect septums to horizontally and fluidically interconnect a supply of fluid of the fluid supply cartridge to the fluid-ejection device. The interface further includes an electrical interface to horizontally conductively connect a digital fluid level sensor of the fluid supply cartridge to a corresponding electrical interface of the fluid-ejection device.

Figure 1A:
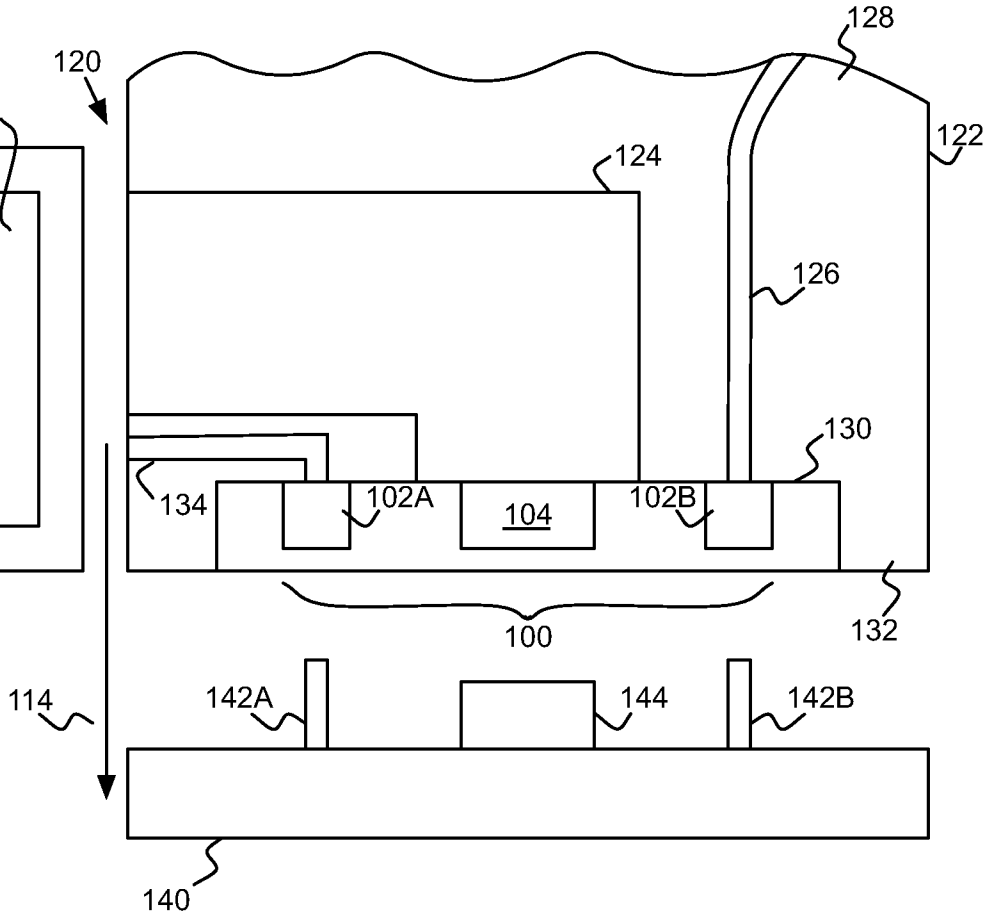
FIGS. 1A and 1B are diagrams of a cross-sectional front view and a side view, respectively, of an example horizontal interface for a fluid supply cartridge to connect the fluid supply cartridge to a fluid-ejection device.
Figure 1B:
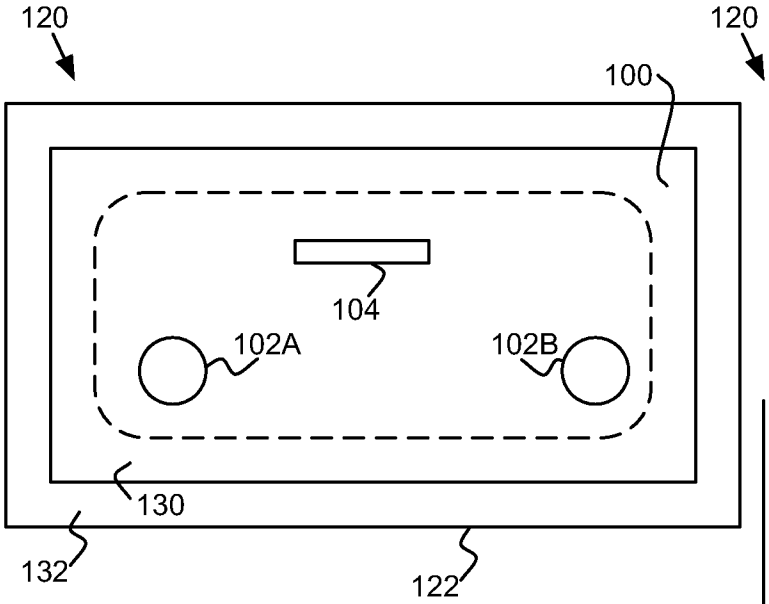

FIGS. 1A and 1B show a cross-sectional front view and a side view, respectively, of an example horizontal interface 100 for a fluid supply cartridge 120 to connect the cartridge 120 to a fluid-ejection device 140. Portions of the fluid supply cartridge 120 and the fluid-ejection device 140 are depicted in FIG. 1A. The side view of FIG. 1B is looking from the right towards the left of the front view of FIG. 1 (i.e., opposite the direction of the arrow 114).

The interface 100 is a horizontal interface in that the fluid supply cartridge 120 is inserted in a horizontal direction, such as from the left to the right as indicated by the arrow 114, to connect the cartridge 120 to the fluid-ejection device 140. The interface 100 is disposed at a surface 130 of a housing 122 of the fluid supply cartridge 120, which may be a recessed surface at a back of a cavity defined by a lip 132 of the housing 122. The interface 100 includes an electrical interface 104 and fluidic interconnect septums 102A and 102B, which are collectively referred to as the fluid interconnect septums 102. In the example of FIGS. 1A and 1B, the electrical interface 104 is disposed between the septums 102.

The electrical interface 104 of the horizontal interface 100 horizontally conductively connects a digital fluid level sensor 124 of the fluid supply cartridge 120 to a corresponding electrical interface 144 of the fluid-ejection device 140. The electrical interface 144 can be positioned so that an end thereof is positioned at or near the side of the cartridge 120. The fluidic interconnect septums 102 horizontally fluidically interconnect a supply of fluid 128 contained within the housing 122 of the fluid supply cartridge 120 to the fluid-ejection device 140, such as via corresponding needles 142A and 142B, collectively referred to as the needles 142, of the device 140 piercing into and through the septums 102.

In the example of FIGS. 1A and 1B, the septum 102A can be a supply septum to supply the fluid 128 of the cartridge 120 to the fluid-ejection device 140 via the corresponding needle 142A piercing into and through the septum 102A. As such, the septum 102A can be fluidically interconnected to a pick-up tube 134 within the housing 122 that has a bend towards the bottom of the cartridge 120. The fluidic interconnection between the tube 134 and the septum 102A permits more of the fluid 128, which pools at the bottom of the cartridge 120 due to gravity, to be supplied to the device 140.

In the example of FIGS. 1A and 1B, the septum 102B can be a return septum to return unused fluid and replacement air from the fluid-ejection device 140 to the cartridge 120 via the corresponding needle 142B piercing into and through the septum 102B. As such, the septum 102B can be fluidically interconnected to a return tube 126 within the housing 122, which can have an upwards bend towards the top of the cartridge 120. The fluidic interconnection between the tube 126 and the septum 102B ensures that such unused fluid and air are returned within the housing 122 at a level above the level of the fluid 128 within the housing 122.

Figure 2A:
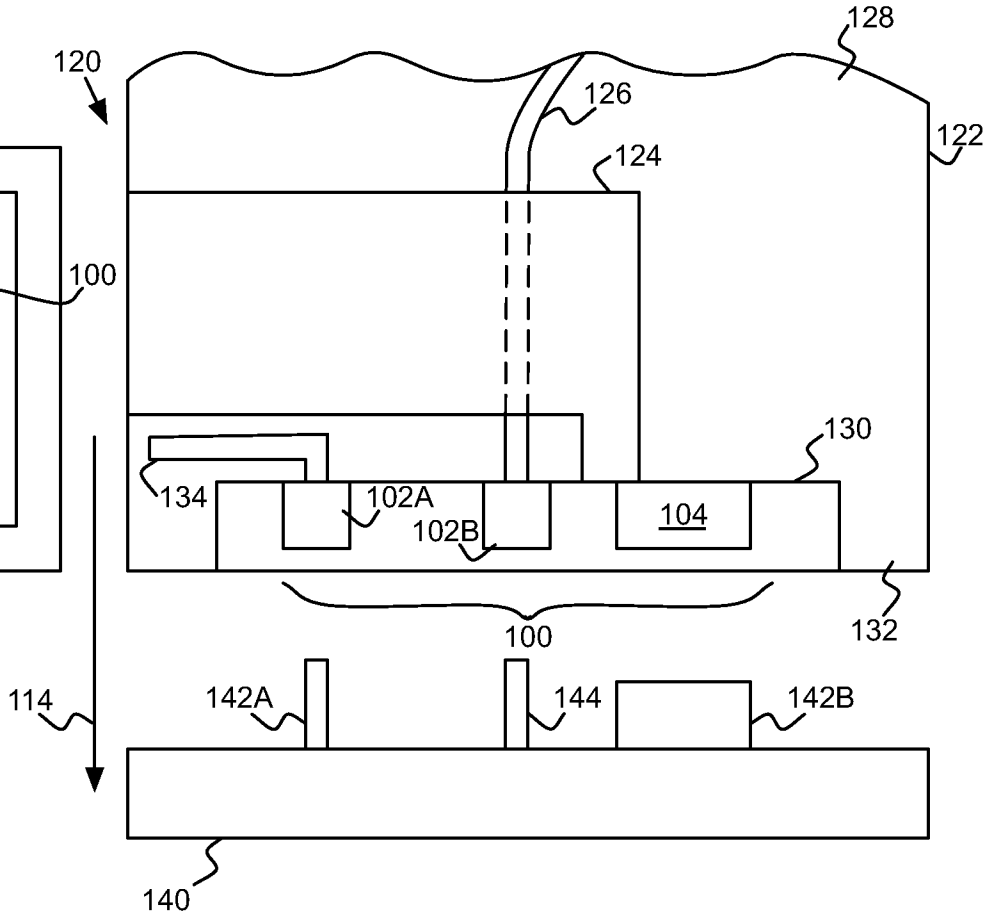
FIGS. 2A and 2B are diagrams of a cross-sectional front view and a side view, respectively, of another example horizontal interface for a fluid supply cartridge to connect the fluid supply cartridge to a fluid-ejection device.
Figure 2B:
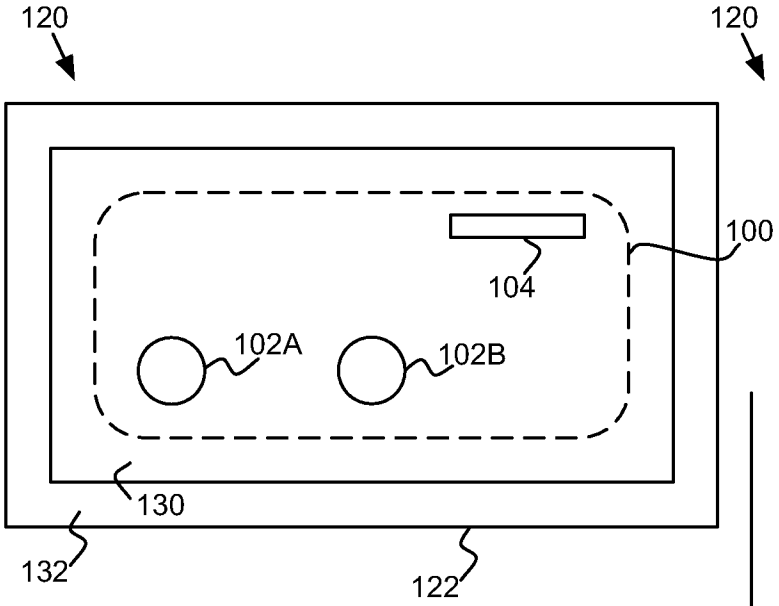

FIGS. 2A and 2B show a cross-sectional front view and a side view, respectively, of another example horizontal interface 100 for a fluid supply cartridge 120 to connect the cartridge 120 to a fluid-ejection device 140. Portions of the fluid supply cartridge 120 and the fluid-ejection device 140 are depicted in FIG. 2A. The side view of FIG. 2B is from the right towards the left of the front view of FIG. 1 (i.e., opposite the direction of the arrow 114).

As in FIGS. 1A and 1B, the interface 100 of FIGS. 2A and 2B is a horizontal interface in that the cartridge 120 is inserted in a horizontal direction, such as from the left to the right as indicated by the arrow 114, to connect the cartridge 120 to the fluid-ejection device 140. The interface 100 is disposed at a surface 130 of a housing 122 of the fluid supply cartridge 120, which may be a recessed surface at a back of a cavity defined by a lip 132 of the housing 122. The interface 100 includes an electrical interface 104 and fluidic interconnect septums 102A and 102B, which are collectively referred to as the fluid-interconnect septums 102.

In the example of FIGS. 2A and 2B, the septums 102 are disposed to the same side of the electrical interface 104. For instance, the septum 102B may be disposed below the electrical interface 104, and the septum 102B may be disposed below the septum 102A. In the example of FIGS. 2A and 2B, then, the septums 102 are both disposed below the electrical interface 104. In another implementation, however, both septums 102 may be disposed above the electrical interface 104.

As in FIGS. 1A and 1B, the electrical interface 104 of the horizontal interface 100 in FIGS. 2A and 2B horizontally conductively connects a digital fluid level sensor 124 of the fluid supply cartridge 120 to a corresponding electrical interface 144 of the fluid-ejection device 140. Also as in FIGS. 1A and 1B, the fluidic interconnect septums 102 in FIGS. 2A and 2B horizontally fluidically interconnect a supply of fluid 128 contained within the housing 122 of the fluid supply cartridge 120 to the fluid-ejection device 140, such as via corresponding needles 142A and 142B, collectively referred to as the needles 142, of the device 140 piercing into and through the septums 102.

The septum 102A can be a supply septum to supply the fluid 128 of the cartridge 120 to the fluid-ejection device 140 via the corresponding needle 142A piercing into and through the septum 102A. As such, the septum 102A can be fluidically interconnected to a pick-up table 134 within the housing 122 that has a bend towards the bottom of the cartridge 120. The fluidic interconnection between the tube 134 and the septum 102A permits more of the fluid 128, which pools at the bottom of the cartridge 120 due to gravity, to be supplied to the device 140.

The septum 102B can be a return septum to return unused fluid and replacement air from the fluid-ejection device 140 to the cartridge 120 via the corresponding needle 142B piercing into and through the septum 102B. As such, the septum 102B can be fluidically interconnected to a tube 126 within the housing 122, which can have an upwards bend towards the top of the cartridge 120 (in FIG. 2A, the dotted portion of the tube 126 indicates that the tube 126 is. The fluidic interconnection between the tube 126 and the septum 102B that ensures that such unused fluid and air are returned within the housing 122 at a level above the level of the fluid 128 within the housing 122.

Figure 3A:
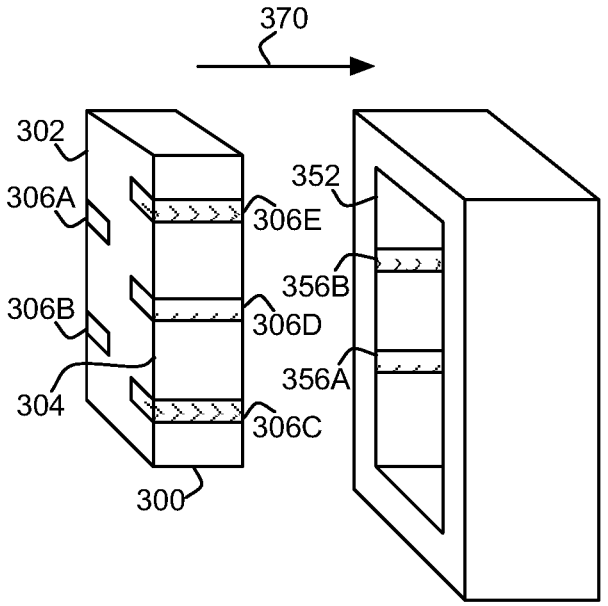
FIG. 3A is a diagram of a perspective view of an example horizontally oriented electrical interface of a horizontal interface for a fluid supply cartridge to connect to a corresponding electrical interface of a fluid-ejection device.
Figure 3B:
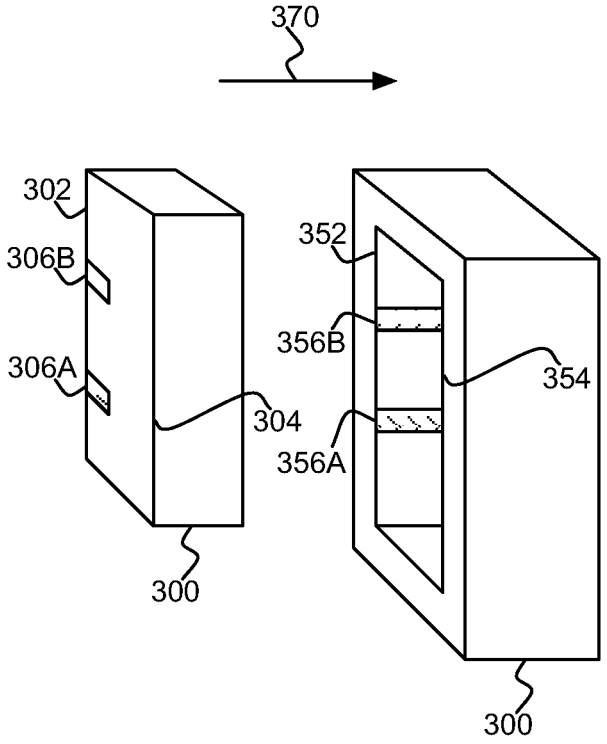
FIG. 3B is a diagram of a perspective view of another example horizontally oriented electrical interface of a horizontally interface for a fluid supply cartridge to connect to a corresponding electrical interface of a fluid-ejection device.

FIGS. 3A and 3B each show a perspective view of horizontally oriented electrical interfaces 300 and 350. In one implementation, the electrical interface 300 can be the electrical interface 104 of the interface 100 for the fluid supply cartridge 120 of FIGS. 1A, 1B, 2A, and 2B, in which case the electrical interface 350 can be the electrical interface 144 of the fluid-ejection device 140. In this implementation, the electrical interface 300 can be moved horizontally from left to right so that it connects to and makes electrical contact with the electrical interface 350, as indicated by an arrow 370. The electrical interface 300 can be a discrete logic board that is connected to the digital fluid level sensor 124 of FIGS. 1A, 1B, 2A, and 2B, or the interface 300 can be an integrated part of the fluid level sensor 124. The electrical interface 350 can be a connector into which the electrical interface 300 is insertable.

In another implementation, the electrical interface 350 can be the electrical interface 104 of the interface 100 for the cartridge 120, in which case the electrical interface 300 can be the electrical interface 144 of the fluid-ejection device 140. In this implementation, the horizontal orientation of the electrical interfaces 300 and 350 may be reversed as compared to that depicted in FIGS. 3A and 3B, such that the electrical interface 350 can be moved horizontally from left to right so that it connects to and makes electrical contact with the electrical interface 300. The electrical interface 350 can be a connector that is connected to the digital fluid level sensor 124 of FIGS. 1A, 1B, 2A, and 2B. The electrical interface 300 can be a circuit board.

The electrical interface 300 has opposing surfaces 302 and 304, and likewise the electrical interface 350 has opposing surfaces 352 and 354. In the example of FIG. 3A, electrical contacts 306A and 306B are disposed on the surface 302 of the interface 300, and electrical contacts 306C, 306D, and 306E are disposed on the surface 304 of the interface 300. Electrical contacts 356A and 356B are likewise disposed on the surface 352 of the interface 350, and which correspond to the electrical contacts 306A and 306B of the interface 300.

There are likewise electrical contacts disposed on the surface 354, which correspond to the electrical contacts 306C, 306D, and 306E on the surface 302, but which are hidden in the perspective view of FIG. 3A. As depicted in FIG. 3A, the number of electrical contacts on the surfaces 302 and 352 differ in number than the number of electrical contacts on the surfaces 304 and 354, but in another implementation the surfaces 302 and 352 can have the same number of electrical contacts as the surfaces 304 and 354.

In the example of FIG. 3B, electrical contacts 306A and 306B are disposed on the surface 302 of the electrical interface 300, but there are no electrical contacts disposed on the surface 304 of the interface 300. There are likewise electrical contacts 356A and 356B disposed on the surface 352 of the electrical interface 350, which correspond to the electrical contacts 306A and 306B of the interface 300. However, there are no electrical contacts disposed on the surface 354 of the electrical interface 350. Therefore, the difference between the examples of FIGS. 3A and 3B is that in the former, the electrical contacts are disposed on both sides of each of the electrical interfaces 300 and 350, whereas in the latter, the electrical contacts are disposed on just one side of each of the electrical interfaces 300 and 350.

In FIGS. 3A and 3B, the electrical interfaces 300 and 350 are referred to as horizontally oriented interfaces. This is because the electrical contacts 306 of the interface 300 conductively connect to the electrical contacts 356 of the interface 350 along horizontal surfaces thereof. That is, the surfaces of the electrical contacts 306 and the surfaces of the electrical contacts 356 that conductively connect to one another are parallel to the horizontal direction, as indicated by the arrow 370, in which the interface 300 is moved from left to right to connect to the interface 350.

Figure 4A:
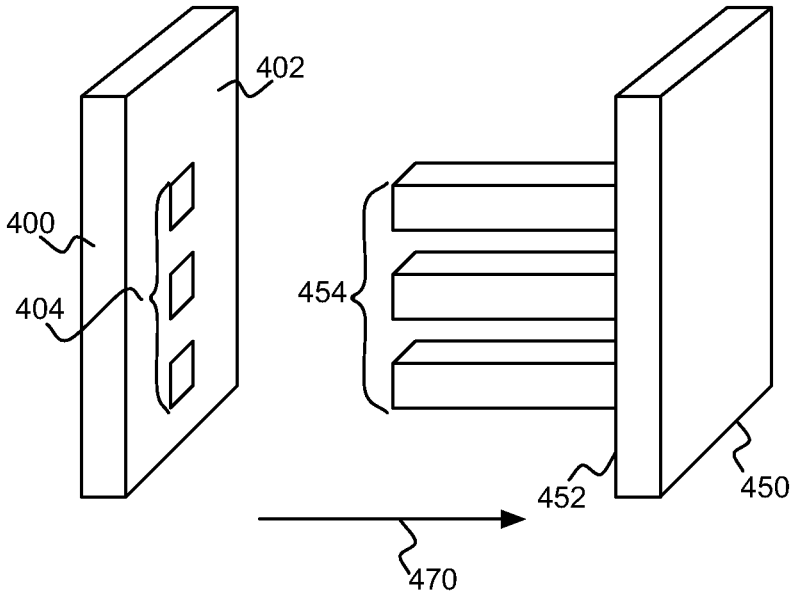
FIG. 4 is a diagram of a perspective view of an example vertically oriented electrical interface of a horizontal interface for a fluid supply cartridge to connect to a corresponding electrical interface of a fluid-ejection device.

FIG. 4 shows a perspective view of vertically oriented electrical interfaces 400 and 450. The interface 400 has a surface 402. Electrical contacts 404 are disposed on the surface 402. The interface 450 has a surface 452. Extending from the surface 452 are electrical contacts 454 that correspond to the electrical contacts 404.

In one implementation, the electrical interface 400 can be the electrical interface 104 of the interface 100 for the fluid supply cartridge 120 of FIGS. 1A, 1B, 2A, and 2B, in which case the electrical interface 450 can be the electrical interface 144 of the fluid-ejection device 140. In this implementation, the electrical interface 400 can be moved horizontally from left to right so that it connects to and makes electrical contact with the electrical interface 450, as indicated by an arrow 470. The electrical interface 400 can be a discrete logic board that is connected to the digital fluid level sensor 124 of FIGS. 1A, 1B, 2A, and 2B. The electrical interface 450 can be a compression connector against which the electrical interface 400 is physically pressable. The electrical interface 400 further can be an integrated part of the fluid level sensor 124.

In another implementation, the electrical interface 450 can be the electrical interface 104 of the interface 100 for the cartridge 120, in which case the electrical interface 400 can be the electrical interface 144 of the fluid-ejection device 140. In this implementation, the horizontal orientation of the electrical interfaces 400 and 450 may be reversed as compared to that depicted in FIG. 4A, such that the electrical interface 450 can be moved horizontally from left to right so that it contacts to and makes electrical contact with the electrical interface 400. The electrical interface 450 can be a compression connector that is connected to the digital fluid level sensor 124 of FIGS. 1A, 1B, 2A, and 2B, and against which the electrical interface 400 is physically pressable. The electrical interface 400 can be a circuit board. The electrical interface 450 further can be an integrated part of the fluid level sensor 124.

The electrical contacts 404 of the electrical interface 400 individually correspond to counterpart electrical contacts 454 of the electrical interface 450. When the interfaces 400 and 450 make contact with one another, the electrical contacts 404 and 454 physically press against one another. As such, the electrical contacts 404 make conductive connections with corresponding electrical contacts 454.

The electrical interfaces 400 and 450 are referred to as vertically oriented interfaces. This is because the electrical contacts 404 of the interface 400 conductively connect to the electrical contacts 454 of the interface 450 along vertical surfaces thereof. That is, the surfaces of the electrical contacts 404 and the surfaces of the electrical contacts 454 that conductively connect to one another are perpendicular to the horizontal direction indicated by the arrow 470 in which the interface 400 is moved from left to right to connect to the interface 450.

Figure 5:
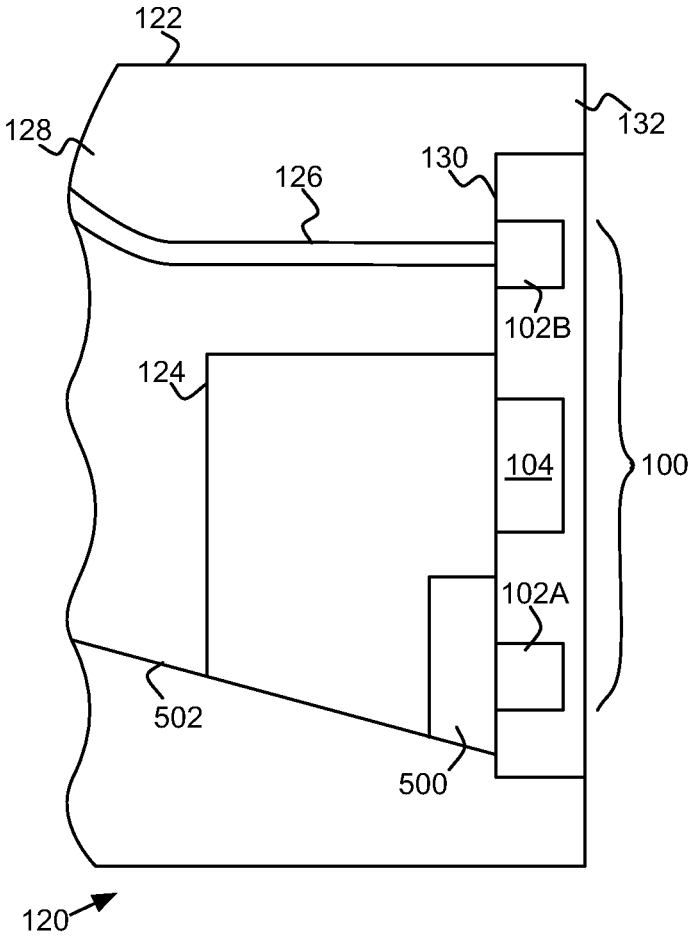
FIG. 5 is a diagram of a cross-sectional front view of an example horizontal interface for a fluid supply cartridge having a sump.

FIG. 5 shows a cross-sectional front view of an example horizontal interface 100 for a fluid supply cartridge 120 to connect the cartridge 120 to a fluid-ejection device. A portion of the fluid supply cartridge 120 is depicted in FIG. 5. The interface 100 is disposed at a surface 130 of a housing 122 of the fluid supply cartridge 120, which may be a recessed surface at a back of a cavity defined by a lip 132 of the housing 122. The interface 100 includes an electrical interface 104 and fluidic interconnect septums 102A and 102B, which are collectively referred to as the fluid interconnect septums 102. In the example of FIG. 5, the electrical interface 104 is disposed between the septums 102, as in FIGS. 1A and 1B, but the septums 102 may also be disposed to the same side of the interface 104, as in FIGS. 2A and 2B.

The electrical interface 104 of the vertical interface 100 horizontally conductively connects a digital fluid level sensor 124 of the fluid supply cartridge 120 to a corresponding electrical interface of a fluid-ejection device. The fluidic interconnect septums 102 horizontally fluidically interconnect a supply of fluid 128 contained within the housing of the fluid supply cartridge 120 to the fluid-ejection device 140. In the example of FIG. 5, the septum 102A is a supply septum to supply the fluid 128 of the cartridge 120 to the fluid-ejection device, and the septum 102B can be a return septum to return unused fluid and replacement air from the fluid-ejection device to the cartridge 120. The septum 102B can be fluidically interconnected to a tube 126 within the housing 122 to ensure that such unused fluid and air are returned within the housing 122 at a level above the level of the fluid 128 within the housing 122, as in FIG. 1A.

The horizontal interface 100 of FIG. 5 differs from that of FIGS. 1A, 1B, 2A, and 2B in that the septum 102A is disposed at a sump 500 of the fluid supply cartridge 120. An internal surface 502 within the housing 122 is present in FIG. 5, and is angled downwards towards the septum 102A. The downward angle of the surface 502 of the housing towards the septum 102A at least partially defines the sump 500.

The presence of the sump 500, and the location of the supply septum 102A at the sump 500, ensures that a maximum amount of the fluid 128 is deliverable to the fluid-ejection device to which the fluid supply cartridge 120 is connected. This is because the fluid 128 is forced downwards via gravity towards the sump, which is defined as a depression in which the fluid 128 collects. In the example of FIG. 5, a pick-up tube, such as a pick-up tube 134 as in FIGS. 1A and 2A, is not depicted, but in another implementation can be present. The example of FIG. 5 can be implemented in relation to the examples of FIGS. 1A, 1B, 2A, and 2B. That is, in the examples of FIGS. 1A, 1B, 2A, and 2B, one or more angled surfaces like the surface 502 can be arranged inside the cartridge 120 to form sump like the sump 500 towards the bottom of the cartridge 120 where the septum 102A is located.

Novel horizontal interfaces for fluid supply cartridges having digital fluid level sensors have been disclosed herein. Such horizontal interfaces permit such fluid supply cartridges to be horizontally inserted into or connected to fluid-ejection devices, so that the devices can eject the fluid contained within the cartridges. As noted above, such a fluid-ejection device can be an inkjet-printing device that ejects ink contained within an ink cartridge.

Figure 6A:
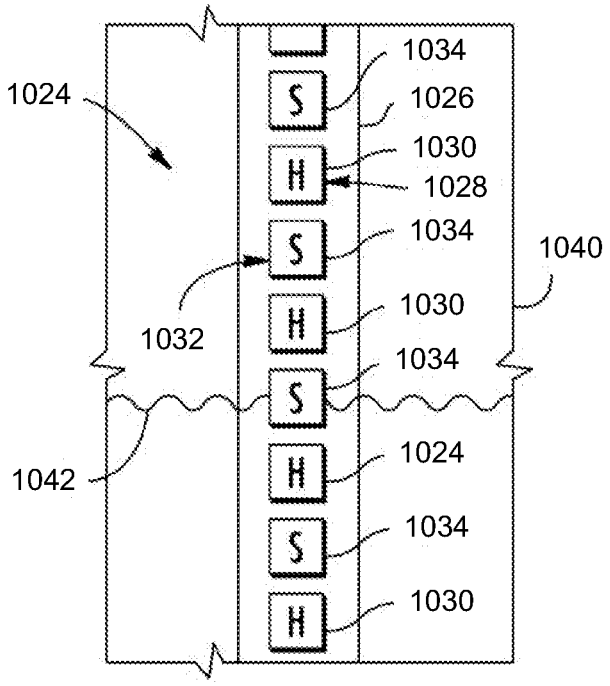
FIG. 6A is a diagram of a portion of an example liquid interface for an example fluid level sensor, according to one example of the principles described herein.
Figure 6B:
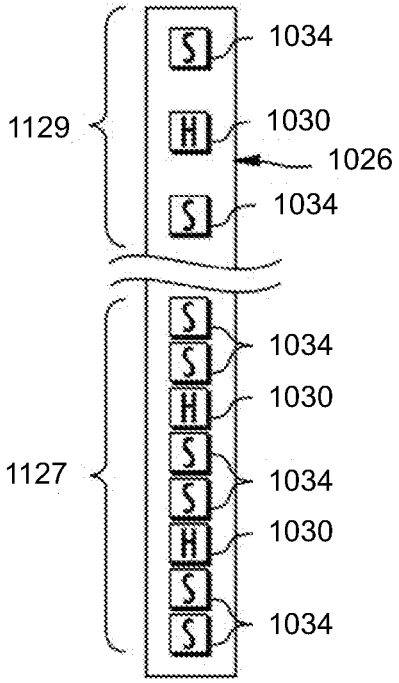
FIG. 6B is a diagram of portions of another example liquid interface for an example fluid level sensor, according to one example of the principles described herein.

An example digital fluid sensor is now described. The example fluid sensor can be part of a fluid supply cartridge for which novel vertical interfaces have been described. FIGS. 6A-6B illustrate an example liquid level sensing interface 1024 for a fluid level sensor. Liquid interface 1024 interacts with liquid within a volume 1040 and outputs signals that indicate the current level of liquid within the volume 1040. Such signals are processed to determine the level of liquid within the volume 1040. Liquid interface 1024 facilitates the detection of the level of liquid within the volume 1040 in a low-cost manner.

As schematically shown by FIGS. 6A-6B, liquid interface 1024 includes strip 1026, a series 1028 of heaters 1030 and a series 1032 of sensors 1034. The strip 1026 includes an elongated strip that is to be extended into volume 1040 containing the liquid 1042. The strip 1026 supports heaters 1030 and sensors 1034 such that a subset of the heaters 1030 and the sensors 1034 are submersed within the liquid 1042, when the liquid 1042 is present.

In one example, the strip 1026 is supported from the top or from the bottom such that those portions of the strip 1026, and their supported heaters 1030 and sensors 1034, submersed within the liquid 1042, are completely surrounded on all sides by the liquid 1042. In another example, the strip 1026 is supported along a side of the volume 1040 such that a face of the strip 1026 adjacent the side of the volume 1040 is not opposed by the liquid 1042. In one example, the strip 1026 includes an elongated rectangular, substantially flat strip. In another example the strip 1026 includes a strip including a different polygon cross-section or a circular or oval cross-section.

The heaters 1030 include individual heating elements spaced along a length of the strip 1026. Each of the heaters 1030 is sufficiently close to a sensor 1034 such that the heat emitted by the individual heater may be sensed by the associated sensor 1034. In one example, each heater 1030 is independently actuatable to emit heat independent of other heaters 1030. In one example, each heater 1030 includes an electrical resistor. In one example, each heater 1030 is emits a heat pulse for a duration of at least 10 μs with a power of at least 10 mW.

In the example illustrated, the heaters 1030 are employed to emit heat and do not serve as temperature sensors. As a result, each of the heaters 1030 may be constructed from a wide variety of electrically resistive materials including a wide range of temperature coefficient of resistance. A resistor may be characterized by its temperature coefficient of resistance, or TCR. The TCR is the resistor's change in resistance as a function of the ambient temperature. TCR may be expressed in ppm/° C., which stands for parts per million per centigrade degree. The temperature coefficient of resistance is calculated as follows:

$$\text{temperature coefficient of a resistor: } TCR=(R2-R1)\ e-6/R1*(T2-T1),$$

where TCR is in ppm/° C., R1 is in ohms at room temperature, R2 is resistance at operating temperature in ohms, T1 is the room temperature in ° C. and T2 is the operating temperature in ° C.

Because the heaters 1030 are separate and distinct from the temperature sensors 1034, a wide variety of thin-film material choices are available in wafer fabrication processes for forming the heaters 1030. In one example, each of the heaters 1030 has a relatively high heat dissipation per area, high temperature stability (TCR<1000 ppm/° C.), and the intimate coupling of heat generation to the surrounding medium and heat sensor. Suitable materials can be refractory metals and their respective alloys such as tantalum, and its alloys, and tungsten, and its alloys, to name a few; however, other heat dissipation devices like doped silicon or polysilicon may also be used.

The sensors 1034 include individual sensing elements spaced along the length of the strip 1026. Each of the sensors 1034 is sufficiently close to a corresponding heater 1030 such that the sensor 1034 may detect or respond to the transfer of heat from the associated or corresponding heater 1030. Each of the sensors 1034 outputs a signal which indicates or reflects the amount of heat transmitted to the particular sensor 1034 following and corresponding to a pulse of heat from the associated heater. The amount of heat transmitted by the associated heater will vary depending upon the medium through which the heat was transmitted prior to reaching the sensor 1034. Liquid 1042 has a higher heat capacity than air 1041. Thus, the liquid 1042 will reduce the temperature detected by sensor 1034 differently with respect to the air 1041. As a result, the differences between signals from sensors 1034 indicate the level of the liquid 1042 within the volume 1040.

In one example, each of the sensors 1034 includes a diode which has a characteristic temperature response. For example, in one example, each of the sensors 1034 includes a P-N junction diode. In other examples, other diodes may be employed or other temperature sensors may be employed.

In the example illustrated, the heaters 1030 and the sensors 1034 are supported by the strip 1026 so as to be interdigitated or interleaved amongst one another along the length of the strip 1026. For purposes of this disclosure, the term "support" or "supported by" with respect to heaters and/or sensors and a strip means that the heaters and/or sensors are carried by the strip such that the strip, heaters, and sensors form a single connected unit. Such heaters and sensors may be supported on the outside or within and interior of the strip. For purposes of this disclosure, the term "interdigitated" or "interleaved" means that two items alternate with respect to one another. For example, interdigitated heaters and sensors may include a first heater, followed by a first sensor, followed by a second heater, followed by a second sensor and so on.

In one example, an individual heater 1030 may emit pulses of heat that are to be sensed by multiple sensors 1034 proximate to the individual heater 1030. In one example, each sensor 1034 is spaced no greater than 20 μm from an individual heater 1030. In one example, the sensors 1034 have a minimum one-dimensional density along strip 1024 of at least 100 sensors 1034 per inch (at least 1040 sensors 1034 per centimeter). The one dimensional density includes a number of sensors per unit measure in a direction along the length of the strip 1026, the dimension of the strip 1026 extending to different depths, defining the depth or liquid level sensing resolution of the liquid interface 1024. In other examples, the sensors 1034 have other one dimensional densities along the strip 1024. For example, the sensors 1034 have a one-dimensional density along the strip 1026 of at least 10 sensors 1034 per inch. In other examples, the sensors 1034 may have a one-dimensional density along the strip 1026 on the order of 1000 sensors per inch 10400 sensors 1034 per centimeter) or greater.

In some examples, the vertical density or number of sensors per vertical centimeter or inch may vary along the vertical or longitudinal length of the strip 1026. FIG. 6A illustrates an example sensor strip 1126 including a varying density of sensors 1034 along its major dimension or launching a length. In the example illustrated, the sensor strip 1126 has greater density of sensors 1034 in those regions along the vertical height or depth may benefit more from a greater degree of depth resolution. In the example illustrated, the sensor strip 1126 has a lower portion 1127 including a first density of sensors 1034 and an upper portion 1129 including a second density of sensors 1034, the second density being less than the first density. In such an example, the sensor strip 1126 provides a higher degree of accuracy or resolution as the level of the liquid within the volume approaches an empty state. In one example, the lower portion 1127 has a density of at least 1040 sensors 1034 per centimeter while upper portion 1129 has a density of less than 10 sensors per centimeter, and in one example, 4 sensors 1034 per centimeter. In yet other examples, an upper portion or a middle portion of the sensor strip 1126 may alternatively have a greater density of sensors as compared to other portions of the sensor strip 1126.

Each of the heaters 1030 and each of the sensors 1034 are selectively actuatable under the control of a controller. In one example, the controller is part of or carried by the strip 1026. In another example, the controller includes a remote controller electrically connected to the heaters 1030 on the strip 1026. In one example, the interface 1024 includes a separate component from the controller, facilitating replacement of the interface 1024 or facilitating the control of multiple interfaces 1024 by a separate controller.

Figure 7:
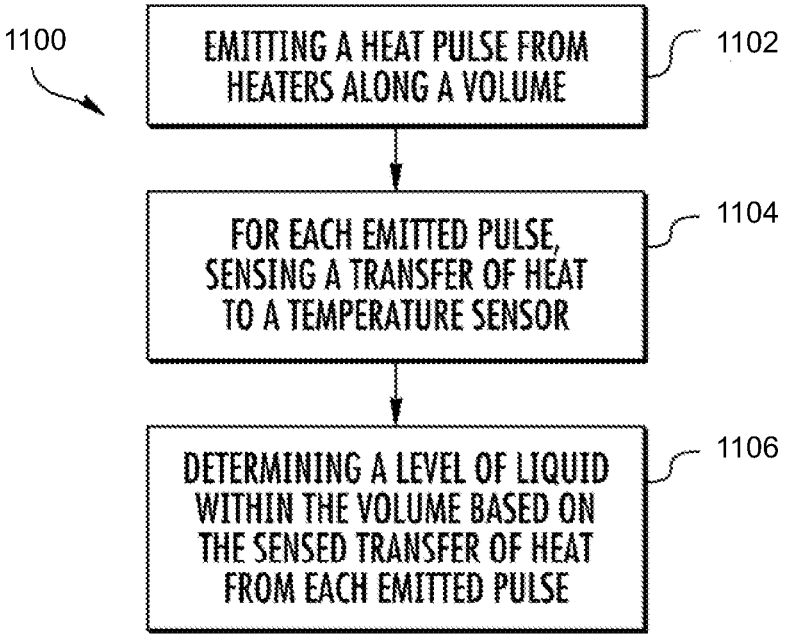
FIG. 7 is a flow diagram of an example method for determining a level of liquid using the fluid level sensor of FIGS. 6A and 6B, according to one example of the principles described herein.

FIG. 7 is a flow diagram of an example method 1100 that may be carried out using a liquid interface, such as the liquid interface 1024, to sense and determine the level of a liquid within a volume. As indicated by block 1102, control signals are sent to heaters 1030 causing a subset of the heaters 1030 or each of the heaters 1030 to turn on and off so as to emit a heat pulse. In one example, control signals are sent to the heaters 1030 such that the heaters 1030 are sequentially actuated or turned on and off (pulsed) to sequentially emit pulses of heat. In one example, the heaters 1030 are sequentially turned on and off, for example, in order from top to bottom along the strip 1026 or from bottom to top along the strip 1026.

In another example, the heaters 1030 are actuated based upon a search algorithm, wherein the controller identifies which of the heaters 1030 should be initially pulsed in an effort to reduce the total time or the total number of heaters 1030 that are pulsed to determine the level of liquid 1042 within volume 1040. In one example, the identification of what heaters 1030 are initially pulsed is based upon historical data. For example, in one example, the controller consults a memory to obtain data regarding the last sensed level of liquid 1042 within the volume 1040 and pulses those heaters 1030 most proximate to the last sensed level of the liquid 1042 before pulsing other heaters 1030 more distant from the last sensed level of the liquid 1042.

In another example, the controller predicts the current level of the liquid 1042 within the volume 1040 based upon the obtained last sensed level of the liquid 1042 and pulses those heaters 1030 proximate to the predicted current level of the liquid 1042 within the volume 1040 pulsing other heaters 1030 more distant from the predicted current level of the liquid 1042. In one example, the predicted current level of the liquid 1042 is based upon the last sensed level of the liquid 1042 and a lapse of time since the last sensing of the level of the liquid 1042. In another example, the predicted current level of the liquid 1042 is based upon the last sensed level of the liquid 1042 and data indicating the consumption or withdrawal of the liquid 1042 from the volume 1040. For example, in circumstances where the liquid interface 1042 is sensing the volume 1040 of an ink in an ink supply, the predicted current level of liquid 1042 may be based upon a last sensed level of the liquid 1042 and data such as the number of pages printed using the ink or the like.

In yet another example, the heaters 1030 may be sequentially pulsed, wherein the heaters 1030 proximate to a center of the depth range of volume 1040 are initially pulsed and wherein the other heaters 1030 are pulsed in the order based upon their distance from the center of the depth range of volume 1040. In yet another example, subsets of heaters 1030 are concurrently pulsed. For example, a first heater and a second heater may be concurrently pulsed where the first heater and the second heater are sufficiently spaced from one another along strip 1026 such that the heat emitted by the first heater is not transmitted or does not reach the sensor intended to sense transmission of heat from the second heater. Concurrently pulsing heaters 1030 may reduce the total time for determining the level of the liquid 1042 within the volume 1040.

In one example, each heat pulse has a duration of at least 10 μs and has a power of at least 10 mW. In one example, each heat pulse has a duration of between 1 and 100 μs and up to a millisecond. In one example, each heat pulse has a power of at least 10 mW and up to and including 10 W.

As indicated by block 1104 in FIG. 7, for each emitted pulse, an associated sensor 1034 senses the transfer of heat from the associated heater to the associated sensor 1034. In one example, each sensor 1034 is actuated, turned on or polled following a predetermined period of time after the pulse of heat from the associated heater. The period of time may be based upon the beginning of the pulse, the end of the pulse or some other time value related to the timing of the pulse. In one example, each sensor 1034 senses heat transmitted from the associated heater 1030 beginning at least 10 μs following the end of the heat pulse from the associated heater 1030. In one example, each sensor 1034 senses heat transmitted from the associated heater 1030 beginning at 1000 μs following the end of the heat pulse from the associated heater 1030. In another example, sensor 1034 initiates the sensing of heat after the end of the heat pulse from the associated heater following a period of time equal to a duration of the heat pulse, wherein such sensing occurs for a period of time of between two to three times the duration of the heat pulse. In yet other examples, the time delay between the heat pulse and the sensing of heat by the associated sensor 1034 may have other values.

As indicated by block 1106 in FIG. 7, the controller or another controller determines a level of the liquid 1042 within the volume 1040 based upon the sensed transfer of heat from each emitted pulse. For example, the liquid 1042 has a higher heat capacity than air 1041. Thus, the liquid 1034 will reduce the temperature detected by sensor 1034 differently with respect to the air 1041. If the level of the liquid 1042 within the volume 1040 is such that liquid is extending between a particular heater 1030 and its associated sensor 1034, heat transfer from the particular heater 1032 to the associated sensor 1034 will be less as compared to circumstances where air 1041 is extending between the particular heater 1030 and its associated sensor 1034. Based upon the amount of heat sensed by the associated sensor 1034 following the emission of the heat pulse by the associated heater 1030, the controller determines whether air or liquid is extending between the particular heater 1030 and the associated sensor. Using this determination and the known location of the heater 1030 and/or sensor 1034 along the strip 1026 and the relative positioning of the strip 1026 with respect to the floor of the volume 1040, the controller determines the level of the liquid 1042 within the volume 1040. Based upon the determined level of the liquid 1042 within the volume 1040 and the characteristics of the volume 1040, the controller is further able to determine the actual volume or amount of liquid remaining within the volume 1040.

In one example, the controller determines the level of liquid within the volume 1040 by consulting a lookup table stored in a memory, wherein the lookup table associates different signals from the sensors 1034 with different levels of liquid within the volume 1040. In yet another example, the controller determines the level of the liquid 1042 within the volume 1040 by utilizing signals from the sensors 1034 as input to an algorithm or formula.

In some examples, method 1100 and the liquid interface 1024 may be used to not only determine an uppermost level or top surface of the liquid 1042 within the volume 1040, but also to determine different levels of different liquids concurrently residing in the volume 1040. For example, due to different densities or other properties, different liquids may layer upon one another while concurrently residing in a single volume 1040. Each of such different liquids may have a different heat transfer characteristic. In such an application, method 1100 and liquid interface 1024 may be used to identify where the layer of a first liquid ends within volume 1040 and where the layer of a second different liquid, underlying or overlying the first liquid, begins.

In one example, the determined level (or levels) of liquid within the volume 1040 and/or the determined volume or amount of liquid within volume 1040 is output through a display or audible device. In yet other examples, the determined level of liquid or the volume of liquid is used as a basis for triggering an alert, warning or the like to user. In some examples, the determined level of liquid or volume of liquid is used to trigger the automatic reordering of replenishment liquid or the closing of a valve to stop the inflow of liquid into the volume 1040. For example, in printers, the determined level of liquid within volume 1040 may automatically trigger reordering of the replacement ink cartridge or replacement ink supply.

Figure 8:
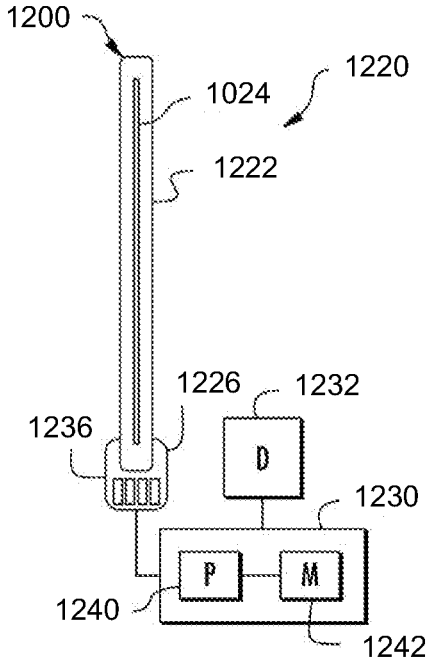
FIG. 8 is a diagram of an example liquid level sensing system, according to one example of the principles described herein.

FIG. 8 illustrates an example liquid level sensing system 1220. Liquid level sensing system 1220 includes a carrier 1222, the liquid interface 1024 described above, an electoral interconnect 1226, a controller 1230 and a display 1232. The carrier 1222 includes a structure that supports the strip 1026. In one example, the carrier 1222 includes a strip 1026 formed from, or that includes, a polymer, glass or other material. In one example, the carrier 1222 has embedded electrical traces or conductors. For example, the carrier 1222 includes composite material composed of woven fiberglass cloth with an epoxy resin binder. In one example, the carrier 1222 includes a glass-reinforced epoxy laminate sheet, tube, rod, or printed circuit board.

Liquid interface 1024, described above, extends along a length of the carrier 1222. In one example, the liquid interface 1024 is glued, bonded or otherwise affixed to the carrier 1222. In some examples, depending upon the thickness and strength of the strip 1026, the carrier 1222 may be omitted.

The electrical interconnect 1226 includes an interface by which signals from the sensors 1034 of interface 1024 as depicted in FIGS. 6A-6B are transmitted to the controller 1230. In one example, the electrical interconnect 1226 includes electrical contact pads 1236. In other examples, the electrical interconnect 1226 may have other forms. The electrical interconnect 1226, the carrier 1222 and the strip 1024, collectively, form a fluid level sensor 1200 that may be incorporated into and fixed as part of a liquid container volume or may be a separate portable sensing device which may be temporarily manually inserted into different liquid containers or volumes.

The controller 1230 includes a processing unit 1240 and associated non-transient computer-readable medium or memory 1242. In one example, the controller 1230 is separate from fluid level sensor 1200. In other examples, controller 1230 is incorporated as part of the sensor 1200. Processing unit 1240 files instructions contained in memory 1242. For purposes of this application, the term "processing unit" shall mean a presently developed or future developed processing unit that executes sequences of instructions contained in a memory. Execution of the sequences of instructions causes the processing unit to generate control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, the controller 1230 may be embodied as part of at least one application-specific integrated circuits (ASICs). Unless otherwise specifically noted, the controller 1230 is not limited to any specific combination of hardware circuitry and software, nor to any particular source for the instructions executed by the processing unit.

The processing unit 1240, following instructions contained in the memory 1242, carries out the method 1100 shown and described above with respect to FIG. 7. The processor 1240, following instructions provided in the memory 1242, selectively pulses the heaters 1030. The processor 1240, following instructions provided in the memory 1242, obtains data signals from the sensors 1034, or in the data signals indicate dissipation of heat from the pulses and the transfer of heat to the sensors 1034. Processor 1240, following instructions provided in memory 1242, determines a level of liquid 1042 within the volume 1040 based upon the signals from the sensors 1034. As noted above, in some examples, the controller 1230 may additionally determine an amount or volume of liquid 1042 using characteristics of the volume 1040 or chamber containing the liquid 1042.

In one example, the display 1232 receives signals from the controller 1230, and presents visible data based upon the determined level of liquid 1042 and/or determined volume or amount of liquid 1042 within the volume 1040. In one example, display 1232 presents an icon or other graphic depicting a percentage of the volume 1040 that is filled with the liquid 1042. In another example, the display 1232 presents an alphanumeric indication of the level of liquid 1042 or percent of the volume 1040 that is filled with the liquid 1042 or that has been emptied of the liquid 1042. In yet another example, the display 1232 presents an alert or "acceptable" status based on the determined level of the liquid 1042 within the volume 1040. In yet other examples, the display 1232 may be omitted, wherein the determined level of liquid within the volume is used to automatically trigger an event such as the reordering of replenishment liquid, the actuation of a valve to add a liquid to the volume or the actuation of the valve to terminate the ongoing addition of liquid 1042 to the volume 1040.

Figure 9:
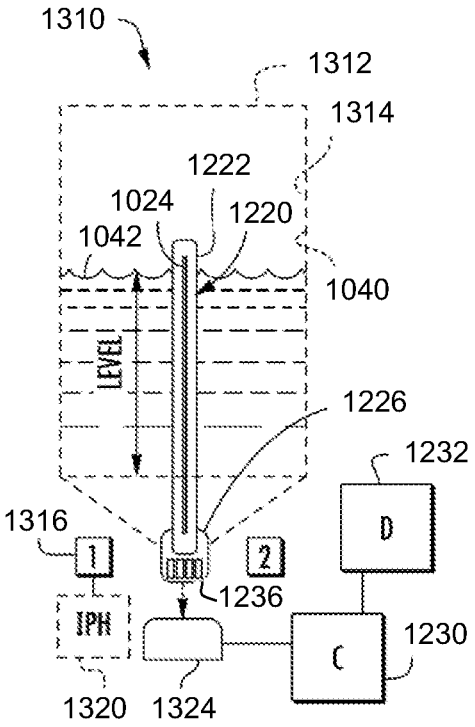
FIG. 9 is a diagram of an example liquid supply system including the liquid level sensing system of FIG. 8, according to one example of the principles described herein.

FIG. 9 is a sectional view illustrating a liquid level sensing system 1220 incorporated as part of a liquid supply system 1310. The liquid supply system 1310 includes a liquid container 1312, a chamber 1314 and a fluid or liquid ports 1316. The container 1312 defines the chamber 1314. The chamber 1314 forms an example volume 1040 in which the liquid 1042 is contained. As shown by FIG. 9, the carrier 1222 and the liquid interface 1024 project into the chamber 1314 from a bottom side of the chamber 1314, facilitating liquid level determinations as the chamber 1314 nears a state of being completely empty. In other examples, the carrier 1222 of the liquid interface 1024 may alternatively be suspended from a top of the chamber 1314.

The liquid ports 1316 include liquid passes by which liquid from within the chamber 1314 is delivered and directed to an external recipient. In one example, the liquid ports 1316 include a valve or other mechanism facilitating selective discharge of liquid from the chamber 1314. In one example, the liquid supply system 1310 includes an off-axis ink supply for a printing system. In another example, the liquid supply system 1310 additionally includes a print head 1320 which is fluidly coupled to the chamber 1314 to receive the liquid 1042 from the chamber 1314 through the liquid interface 1316. In one example, the liquid supply system 1310, including the print head 1320, may form a print cartridge. For purposes of this disclosure, the term "fluidly coupled" means that two or more fluid transmitting volumes are connected directly to one another or are connected to one another by intermediate volumes or spaces such that fluid may flow from one volume into the other volume.

In the example illustrated in FIG. 9, communication between the controller 1230, which is remote or separate from liquid supply system 1310, is facilitated via a wiring connector 1324 such as a universal serial bus connector or other type of connector. The controller 1230 and the display 1232 operate as described above.

Figure 10:
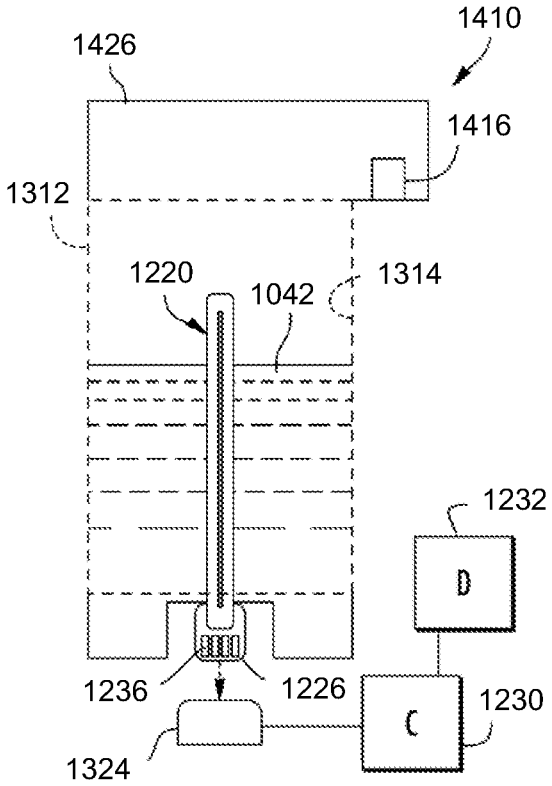
FIG. 10 diagram of another example liquid supply system including the liquid level sensing system of FIG. 8, according to one example of the principles described herein.

FIG. 10 is a sectional view illustrating a liquid supply system 1410; another example of the liquid supply system 1310. The liquid supply system 1410 is similar to the liquid supply system 1310 except that the liquid supply system 1410 includes a liquid port 1416 in place of the liquid port 1316. The liquid port 1416 is similar to the interface of the liquid port 1316 except that the liquid port 1416 is provided in a cap 1426 above the chamber 1314 of the container 1312. Those remaining components of system 1410 which correspond to components of system 1310 are numbered similarly.

Figure 11:
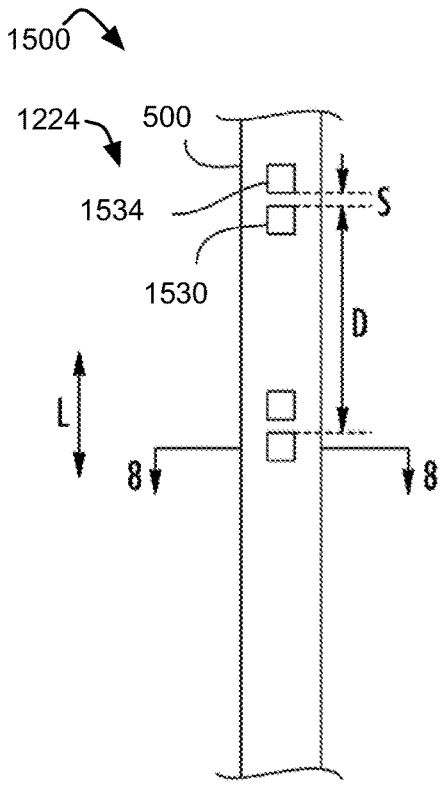
FIG. 11 is a diagram of a portion of another example liquid interface of a fluid level sensor, according to one example of the principles described herein.
Figure 12:
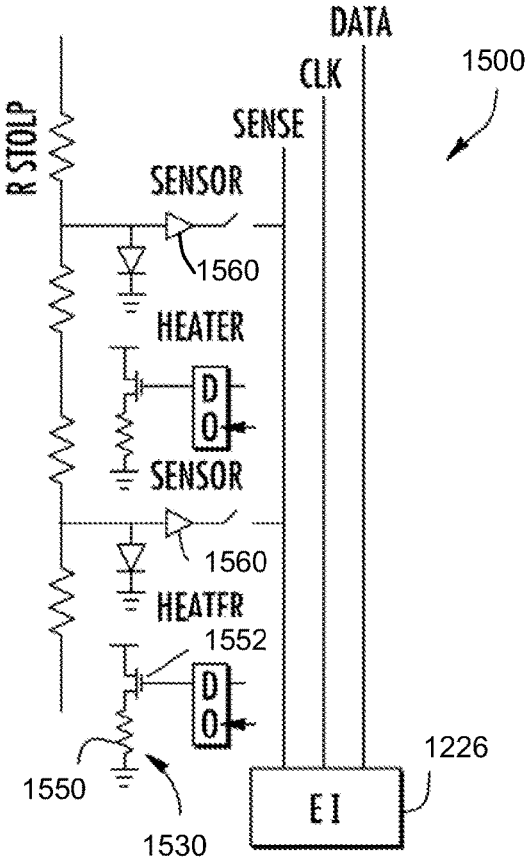
FIG. 12 is an example circuit diagram of the fluid level sensor of FIG. 8, according to one example of the principles described herein.
Figure 13:
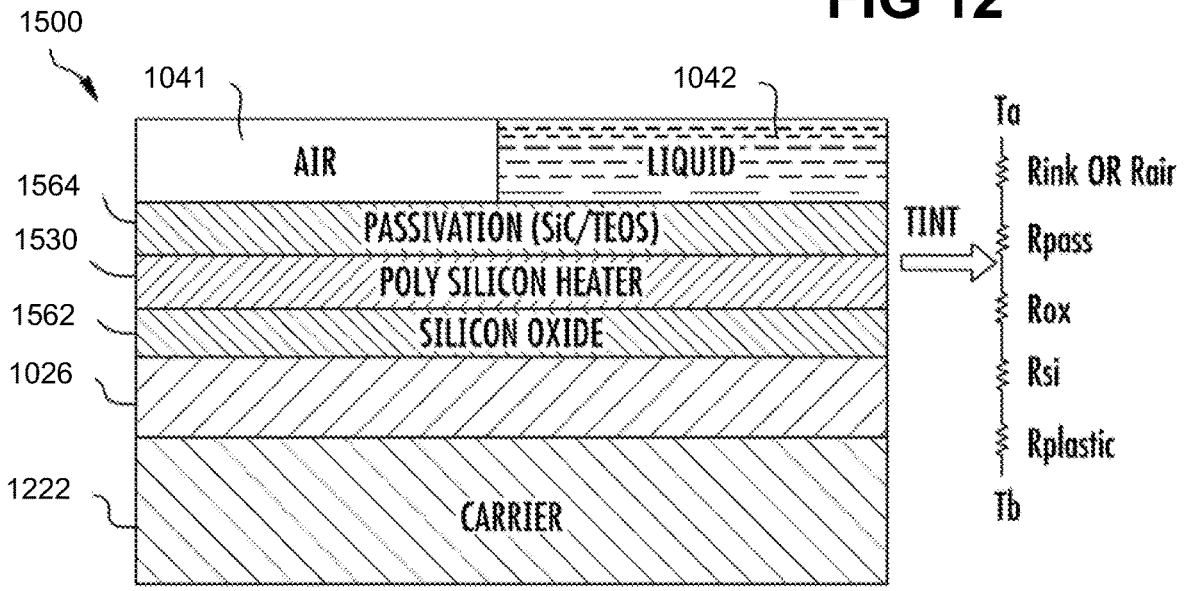
FIG. 13 is a sectional view of the example liquid interface of FIG. 8, according to one example of the principles described herein.

FIGS. 11-13 illustrate a fluid level sensor 1500; another example of the fluid level sensor 1200 of FIG. 8. FIG. 11 is a diagram illustrating a portion of a liquid interface 1224. FIG. 12 is a circuit diagram of a sensor 1500. FIG. 13 is a sectional view through a liquid interface 1224 of FIG. 11 taken along lines 8-8. As shown by FIG. 11, the liquid interface 1224 is similar to the liquid interface 1024 described above in connection with FIGS. 6A-6B in that the liquid interface 1224 includes a strip 1026 which supports a series of heaters 1530 and a series of temperature sensors 1534. In the example illustrated, the heaters 1530 and the temperature sensors 1534 are interdigitated or interleaved along the length (L) of the strip 1026. The length (L) is the major dimension of the strip 1026 that extends across different depths when the sensor 1500 is being used. In the example illustrated, each sensor 1534 is spaced from its associated or corresponding heater 1530 by a spacing distance (S), as measured in a direction along the length (L), of less than or equal to 20 μm and nominally 10 μm. In the example illustrated, the sensors 1534 and their associated heaters 1530 are arranged in pairs, wherein the heaters 1530 of adjacent pairs are separated from one another by a distance (D), as measured in a direction along the length (L), of at least 25 μm to reduce thermal cross talk between consecutive heaters. In one example, consecutive heaters 1530 are separated from one another by a distance (D) of between 25 μm and 2500 μm, and nominally 100 μm.

As depicted in FIG. 12, each heater 1530 includes an electrical resistor 1550 which may selectively turn on and off through the selective actuation of a transistor 1552. Each sensor 1534 includes a diode 1560. In one example, the diode 1560, serving as temperature sensors, includes a P-N junction diode. Each diode 1550 has a characteristic response to changes in temperature. In particular, each diode 1550 has a forward voltage that changes in response to changes in temperature. The diode 1550 exhibits a nearly linear relationship between temperature and applied voltage. Because the temperature sensors 1530 include diodes or semiconductor junctions, the sensor 1500 has a lower cost and can be fabricated upon the strip 1026 using semiconductor fabrication techniques.

FIG. 13 is a sectional view of a portion of one example of the sensor 1500. In the example illustrated, the strip 1026 is supported by the carrier 1222 as described above. In one example, the strip 1026 includes silicon while the carrier 1222 includes a polymer or plastic. In the example illustrated, the heater 1530 includes a polysilicon heater which is supported by the strip 1026, but separated from the strip 1026 by an electrical insulating layer 1562, such as a layer of silicon dioxide. In the example illustrated, the heater 1530 is further encapsulated by an outer passivation layer 1564 which inhibits contact between the heater 1530 and the liquid being sensed. the passivation layer 1564 protects the heaters 1530 and the sensors 1534 from damage that would otherwise result from corrosive contact with the liquid or ink being sensed. In one example, the outer passivation layer 1564 includes silicon carbide and/or tetraethyl orthosilicate (TEOS). In other examples, layers 1562 and 1564 may be omitted or may be formed from other materials.

As shown by FIGS. 12 and 13, the construction of the sensor 1500 creates various layers or barriers providing additional thermal resistances (R). The pulse of heat emitted by the heater 1530 is transmitted across such thermal resistances to the associated sensor 1534. The rate at which the heat from a particular heater 1530 is transmitted to the associated sensor 1534 varies depending upon whether the particular heater 1530 is bordered by air 1041 or a liquid 1042. Signals from the sensor 1534 will vary depending upon whether they were transmitted across air 1041 or liquid 1042. Different signals are used to determine the current level of the liquid 1042 within a volume 1040.

Figure 14A:
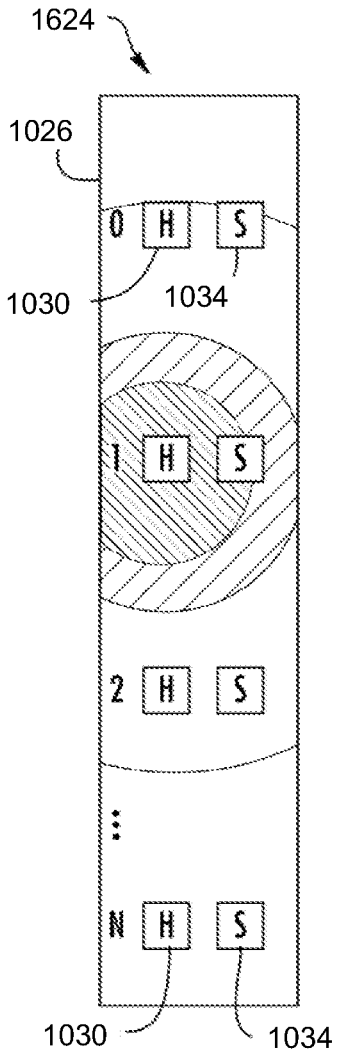
FIG. 14A is a fragmentary front view of the fluid level sensor of FIG. 8, illustrating an example heat spike resulting from the pulsing of a heater, according to one example of the principles described herein.
Figure 14B:
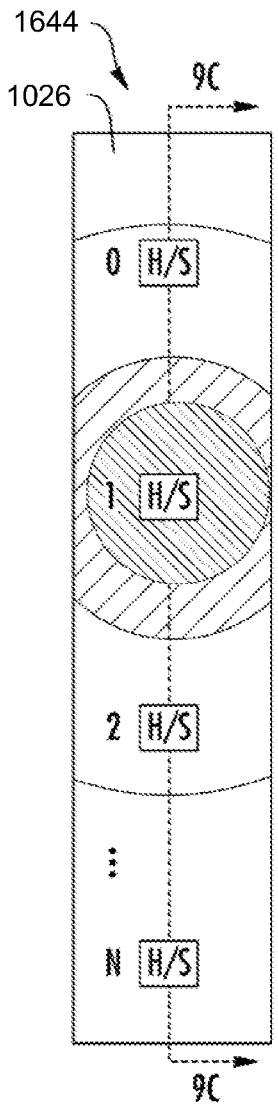
FIG. 14B is a fragmentary front view of another example fluid level sensor, illustrating an example heat spike resulting from the pulsing of a heater, according to one example of the principles described herein.
Figure 14C:
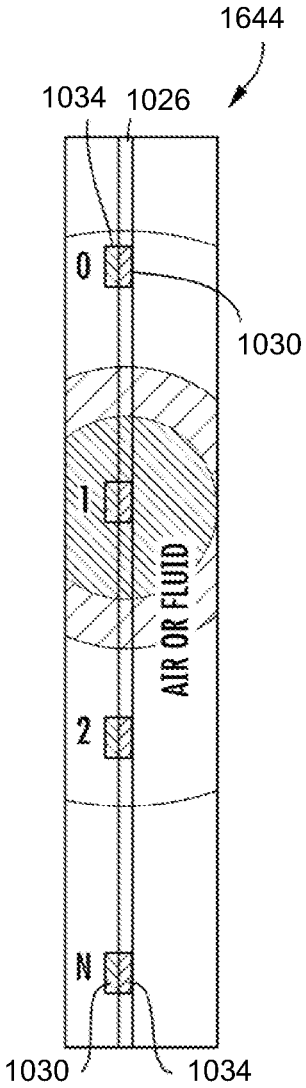
FIG. 14C is a sectional view of the example fluid level sensor of FIG. 14B, illustrating the example heat spike resulting from the pulsing of the heater, according to one example of the principles described herein.

FIGS. 14A, 14B and 14C illustrate liquid interfaces 1624 and 1644; other examples of the liquid interface 1024. In FIG. 14A, heaters and sensors are arranged in pairs labeled 0, 1, 2, . . . N. The liquid interface 1624 is similar to the liquid interface 1024 of FIGS. 6A-6B except that rather than being interleaved or interdigitated vertically along the length of the strip 1026, the heaters 1030 and the sensors 1034 are arranged in an array of side-by-side pairs vertically along the length of the strip 1026.

FIGS. 14B and 14C illustrate a liquid interface 1644; another example of the liquid interface 1024 of FIGS. 6A-6B. The liquid interface 1644 is similar to the liquid interface 1024 of FIGS. 6A-6B except that the heaters 1030 and sensors 1034 are arranged in an array of stacks vertically spaced along the length of strip 1026. FIG. 14C is a sectional view of the interface 1644 further illustrating the stacked arrangement of the pairs of heaters 1030 and sensors 1034.

FIGS. 14A-14C additionally illustrate an example of pulsing of the heater 1030 of the heater/sensor pair 1, and the subsequent dissipation of heat through the adjacent materials. In FIGS. 14A-14C, the temperature or intensity of the heat dissipates or declines as the heat travels further away from the source of the heat, i.e., the heater 1030 of heater/sensor pair 1. The dissipation of heat is illustrated by the change of crosshatching in FIGS. 14A-14C.

Figure 15:
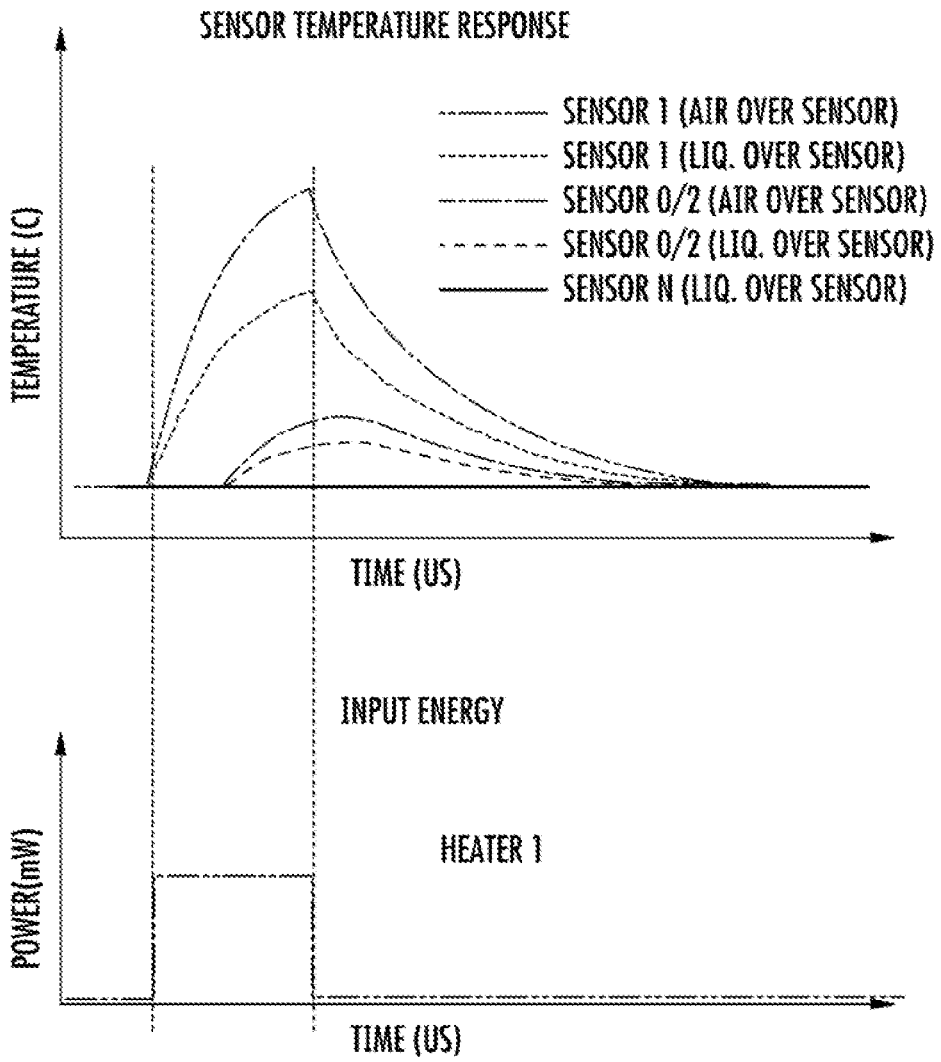
FIG. 15 is a graph illustrating an example of different sensed temperature responses over time to a heater impulse, according to one example of the principles described herein.

FIG. 15 illustrates a pair of time synchronized graphs of the example pulsing shown in FIGS. 14A-14C. FIG. 15 illustrates the relationship between the pulsing of the heater 1030 of the heater sensor pair 1 and the response over time by sensors 1034 of the heater/sensor pairs (0, 1, 2, . . . N). As shown by FIG. 15, the response of each of the sensors 1034 of each pair (0, 1, 2, . . . N) varies depending upon whether air or liquid is over or adjacent to the respective heater/sensor pair (0, 1, 2, . . . N). The characteristic transient curve and magnitude scale are different in the presence of air versus in the presence of liquid. As a result, signals from interface 1644, as well as other interfaces such as interfaces 1024 and 1624, indicate the level of liquid within the volume.

In one example, a controller, such as the controller 1230 described above, determines a level of liquid within the sensed volume by individually pulsing the heater 1030 of a pair of heaters/sensors, and compares the magnitude of the temperature, as sensed from the sensor of the same pair, relative to the heater pulsing parameters to determine whether liquid or air is adjacent to the individual heater/sensor pair. The controller 1230 carries out such pulsing and sensing for each pair of the array until the level of the liquid within the sensed volume is found or identified. For example, controller 1230 may first pulse heater 1030 of pair 0 and compare the sensed temperature provided by sensor 1034 of pair 0 to a predetermined threshold. Thereafter, controller 1030 may pulse heater 1030 of pair 1 and compare the sensed temperature provided by sensor 1034 of pair 1 to a predetermined threshold. This process is repeated until the level of the liquid is found or identified.

In another example, a controller, such as controller 1230 described above, determines a level of liquid within the sensed volume by individually pulsing the heater 1030 of a pair and comparing multiple magnitudes of temperature as sensed by the sensors of multiple pairs. For example, controller 1230 may pulse the heater 1030 of pair 1 and thereafter compare the temperature sensed by sensor 1034 of pair 1, the temperature sensed by sensor 1034 of pair 0, the temperature sensed by sensor 1034 of pair 2, and so on, each temperature resulting from the pulsing of the heater 1030 of pair 1. In one example, the controller 1230 may utilize the analysis of the multiple magnitudes of temperature from the different sensors 1034 vertically along the liquid interface, resulting from a single pulse of heat, to determine whether liquid or air is adjacent to the heater sensor pair including the heater that was pulsed. In such an example, the controller 1230 carries out such pulsing and sensing by separately pulsing the heater of each pair of the array and analyzing the resulting corresponding multiple different temperature magnitudes until the level of the liquid 1042 within the sensed volume 1040 is found or identified.

In another example, the controller 1230 may determine the level of the liquid 1042 within the sensed volume 1040 based upon the differences in the multiple magnitudes of temperature vertically along the liquid interface resulting from a single heat pulse. For example, if the magnitude of temperature of a particular sensor 1034 drastically changes with respect to the magnitude of temperature of an adjacent sensor 1034, the drastic change may indicate that the level of liquid 1042 is at or between the two sensors 1034. In one example, the controller 1230 may compare differences between the temperature magnitudes of adjacent sensors 1034 to a predefined threshold to determine whether the level of the liquid 1042 is at or between the known vertical locations of the two sensors 1034.

In yet other examples, a controller, such as controller 1230 described above, determines the level of the liquid 1042 within the sensed volume 1040 based upon the profile of a transient temperature curve based upon signals from a single sensor 1034 or multiple transient temperature curves based upon signals from multiple sensors 1034. In one example, a controller, such as controller 1230 described above, determines a level of liquid 1042 within the sensed volume 1040 by individually pulsing the heater 1030 of a pair (0, 1, 2, . . . N) and comparing the transient temperature curve produced by the sensor of the same pair (0, 1, 2, . . . N), relative to the predefined threshold or a predefined curve to determine whether liquid 1042 or air 1041 is adjacent to the individual heater/sensor pair (0, 1, 2, . . . N). The controller 1230 carries out such pulsing and sensing for each pair (0, 1, 2, . . . N) of the array until the level of the liquid 1042 within the sensed volume 1040 is found or identified. For example, controller 1230 may first pulse heater 1030 of pair 0 and compare the resulting transient temperature curve produced by sensor 1034 of pair 0 to a predetermined threshold or predefined comparison curve. Thereafter, the controller 1230 may pulse heater 1030 of pair 1 and compare the resulting transient temperature curve produced by the sensor 1034 of pair 1 to a predetermined threshold or predefined comparison curve. This process is repeated until the level of the liquid 1042 is found or identified.

In another example, a controller, such as controller 1230 described above, determines a level of the liquid 1042 within the sensed volume 1040 by individually pulsing the heater 1030 of a pair (0, 1, 2, . . . N) and comparing multiple transient temperature curves produced by the sensors 43 of multiple pairs (0, 1, 2, . . . N). For example, the controller 1230 may pulse the heater 1030 of pair 1 and thereafter compare the resulting transient temperature curve produced by the sensor 1034 of pair 1, the resulting transient temperature curve produced by the sensor 1034 of pair 0, the resulting transient temperature curve produced by the sensor 1034 of pair 2, and so on, each transient temperature curve resulting from the pulsing of the heater 1030 of pair 1. In one example, the controller 1230 may utilize the analysis of the multiple transient temperature curves from the different sensors 1034 vertically along the liquid interface, resulting from a single pulse of heat, to determine whether liquid 1042 or air 1041 is adjacent to the heater sensor pair (0, 1, 2, . . . N) including the heater 1030 that was pulsed. In such an example, the controller 1230 carries out such pulsing and sensing by separately pulsing the heater 1030 of each pair (0, 1, 2, . . . N) of the array and analyzing the resulting corresponding multiple different transient temperature curves until the level of the liquid 1042 within the sensed volume 1040 is found or identified.

In another example, the controller 1230 may determine the level of liquid 1042 within the sensed volume 1040 based upon the differences in the multiple transient temperature curves produced by different sensors 1034 vertically along the liquid interface resulting from a single heat pulse. For example, if the transient temperature curve of a particular sensor 1034 drastically changes with respect to the transient temperature curve of an adjacent sensor 1034, the drastic change may indicate that the level of liquid 1042 is at or between the two sensors 1034. In one example, the controller 1230 may compare differences between the transient temperature curves of adjacent sensors 1034 to a predefined threshold to determine whether the level of the liquid 1042 is at or between the known vertical locations of the two sensors (0, 1, 2, . . . N).

Figure 17:
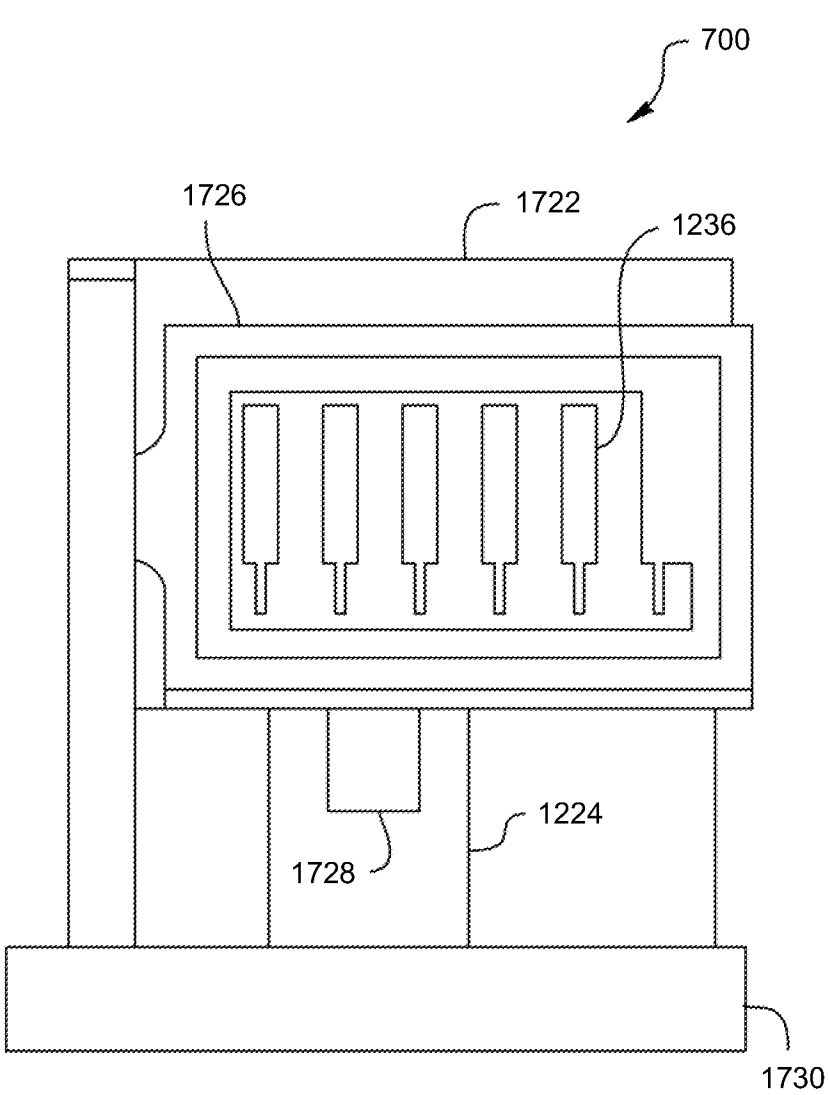
FIG. 17 is an enlarged view of a portion of the example fluid level sensor of FIG. 16, according to one example of the principles described herein.
Figure 16:
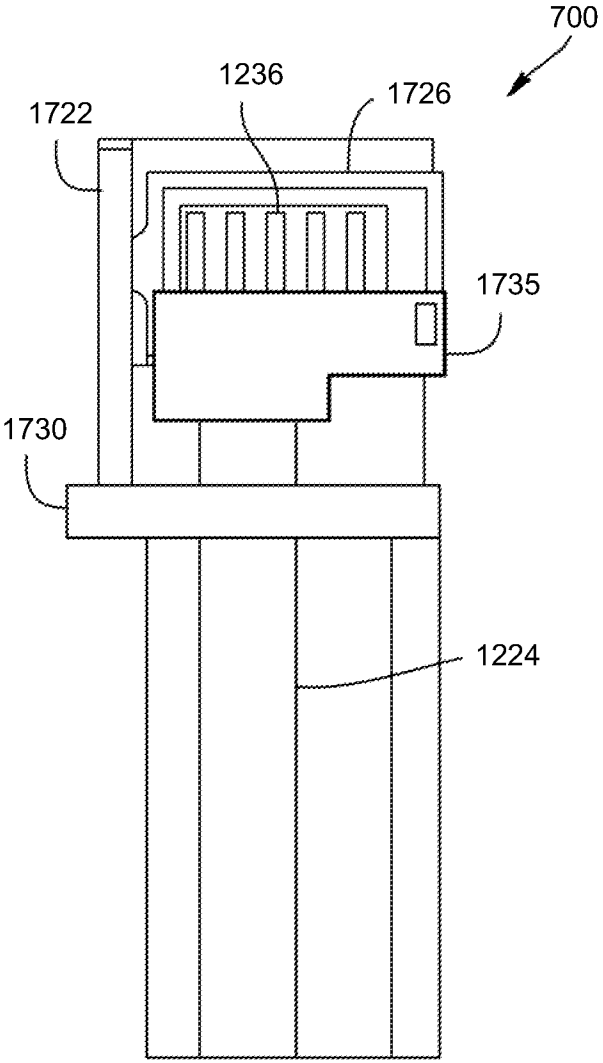
FIG. 16 is a diagram of another example fluid level sensor, according to one example of the principles described herein.

FIGS. 16 and 17 illustrate a sensor 1700; an example of sensor 1500 of FIGS. 11-13. The sensor 1700 includes a carrier 1722, a liquid interface 1224, an electrical interface 1726, a driver 1728, and a collar 1730. The carrier 1722 is similar to the carrier 1222 described above. In the example illustrated, the carrier 1722 includes a molded polymer. In other examples, the carrier 1722 may include a glass or other materials.

The liquid interface 1224 is described above. The liquid interface 1224 is bonded, glued, or otherwise adhered to a face of the carrier 1722 along the length of the carrier 1722. The carrier 1722 may be formed from, or include, glass, polymers, FR4, or other materials.

The electrical interface 1726 includes a printed circuit board including electrical contact pads 1236 for making an electrical connection with the controller 1230 described above with respect to FIGS. 8-10. In the example illustrated, electrical interface 1726 is bonded or otherwise adhered to the carrier 1722. The electrical interface 1726 is electrically connected to the driver 1728 as well as the heaters 1530 and sensors 1534 of the liquid interface 1224 of, for example, FIG. 11. In one example, the driver 1728 includes an application-specific integrated circuit (ASIC) which drives the heaters 1530 and the sensors 1534 in response to signals received through the electrical interface 1726. In other examples, the driving of the heaters 1530 and the sensing by the sensors 1534 may alternatively be controlled by a fully integrated driver circuit in lieu of an ASIC.

The collar 1730 extends about the carrier 1722, and serves as a supply integration interface between carrier 1722 and the liquid container 1040 in which the sensor 1700 is used to detect the level of the liquid 1042 within the volume 1040. In some examples, the collar 1730 provides a liquid seal, separating liquid contained within the volume 1040 that is being sensed and electrical interface 1726. As shown by FIG. 16, in some examples, the driver 1728 as well as the electrical connections between driver 1728, the liquid interface 1224, and the electrical interface 1726 are further covered by a protective electrically insulating wire bond adhesive or encapsulant 1735 such as a layer of epoxy molding compound.

Figure 18A:
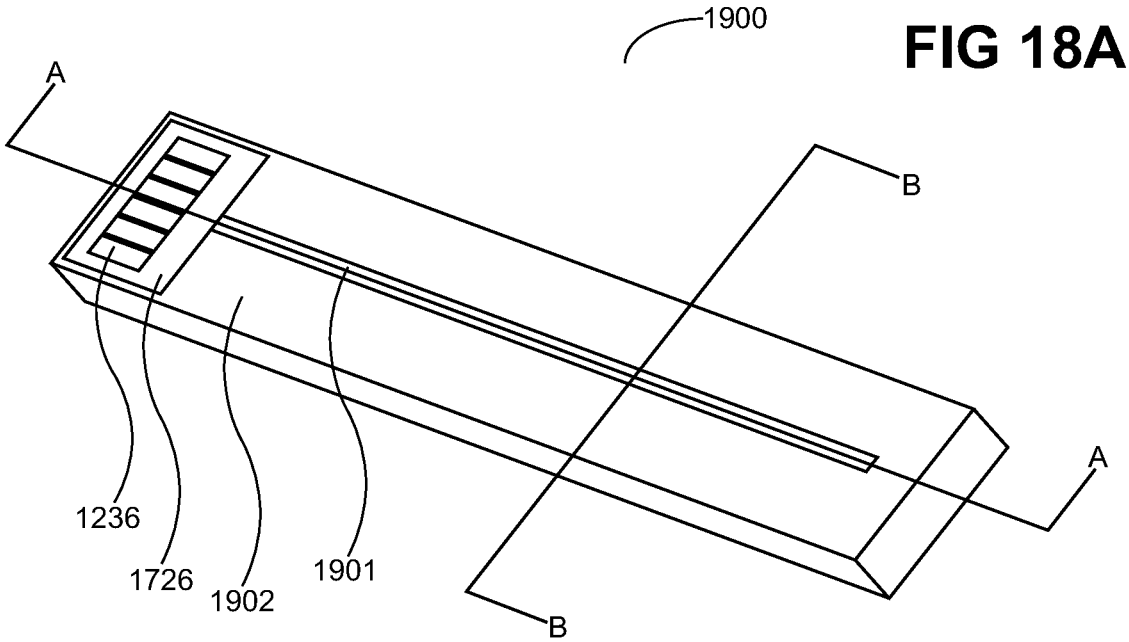
FIG. 18A is an isometric view of a fluid level sensor, according to one example of the principles described herein.

FIG. 18A is an isometric view of a fluid level sensor 1900, according to one example of the principles described herein. The fluid level sensor 1900 includes an electrical interface 1726 including a printed circuit board including electrical contact pads 1236 for making an electrical connection with the controller 1230 as described above with respect to FIGS. 8-10. The fluid level sensor 1900 further includes a sliver die 1901 overmolded with the electrical interface 1726 into a moldable substrate 1902.

Figure 18B:
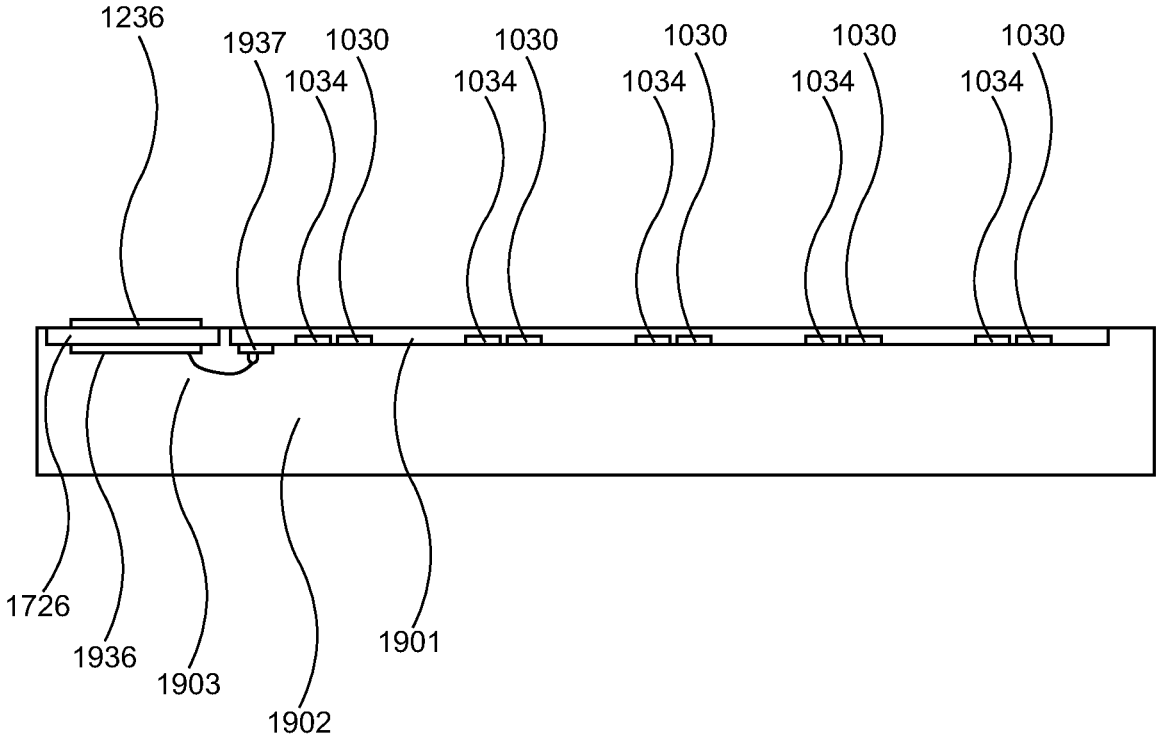
FIG. 18B is a side, cutaway view of the fluid level sensor of FIG. 18A along line A, according to one example of the principles described herein.

FIG. 18B is a side, cutaway view of the fluid level sensor 1900 of FIG. 18A along line A, according to one example of the principles described herein. The electrical interface 1726 is electrically coupled to the sliver die 1901 via a wire bond 1903 extending between a contact pads 1936 located on a side of the electrical interface 726 opposite the electrical contact pads 1236, and an electrical contact pad 1937 located on the sliver die 1901. An array of heaters 1030 and sensors 1034 are disposed on the sliver die 1901 on a side opposite where the fluid level sensor 1900 comes into contact with air 1041 or a liquid 1042 as will be described in more detail below. Although several heaters 1030 and sensors 1034 are disposed on the sliver die 1901 of FIG. 18B, any number of heaters 1030 and sensors 1034 may be disposed on the sliver die 1901 as described herein.

We claim:

1. A horizontal interface for a fluid supply cartridge to connect the fluid supply cartridge to a fluid-ejection device, comprising:

one or more fluidic interconnect septums to horizontally fluidically interconnect a supply of fluid of the fluid supply cartridge to the fluid-ejection device; and a horizontally oriented electrical interface to horizontally conductively connect a digital fluid level sensor of the fluid supply cartridge to a corresponding electrical interface of the fluid-ejection device, wherein the horizontally oriented electrical interface is a circuit board insertable into a corresponding connector of the corresponding electrical interface of the fluid-ejection device, or the horizontally oriented electrical interface is a connector into which a corresponding circuit board of the corresponding electrical interface of the fluid-ejection device is insertable.

2. The horizontal interface of claim 1, wherein the fluid interconnect septum is a first fluidic interconnect septum to supply the fluid of the fluid supply cartridge to the fluid-ejection device, and wherein the horizontal interface further comprises a second fluidic interconnect septum to return the fluid and air from the fluid-ejection device to the fluid supply cartridge.

3. The horizontal interface of claim 2, wherein the first fluidic interconnection is disposed below the second fluidic interconnect septum, and the second fluidic interconnect septum is disposed below the horizontally oriented electrical interface.

4. The horizontal interface of claim 2, wherein the first fluidic interconnection is disposed below the horizontally oriented electrical interface, and the horizontally oriented electrical interface is disposed below the second fluidic interconnect septum.

5. The horizontal interface of claim 1, wherein the horizontally oriented electrical interface is an integrated part of the digital fluid level sensor.

6. A fluid supply cartridge horizontally insertable into a fluid-ejection device, comprising:

a housing;

a supply of fluid within the housing;

a digital fluid level sensor within the housing and in contact with the fluid to measure a level of the fluid within the housing; and a horizontal interface at an end of the housing to connect the fluid supply cartridge to a fluid-ejection device, comprising:

a fluid interconnect septum to horizontally fluidically interconnect the supply of fluid to the fluid-ejection device; and a horizontally oriented electrical interface to horizontally conductively connect the digital fluid level sensor to a corresponding electrical interface of the fluid-ejection device, wherein the horizontally oriented electrical interface is a circuit board insertable into a corresponding connector of the corresponding electrical interface of the fluid-ejection device.

7. The fluid supply cartridge of claim 6, wherein the fluid interconnect septum is a first fluidic interconnect septum to supply the fluid of the fluid supply cartridge to the fluid-ejection device, and wherein the horizontal interface further comprises a second fluidic interconnect septum to return the fluid and air from the fluid-ejection device to the fluid supply cartridge.

8. The fluid supply cartridge of claim 7, wherein the first fluidic interconnection is disposed below the second fluidic interconnect septum, and the second fluidic interconnect septum is disposed below the horizontally oriented electrical interface.

9. The fluid supply cartridge of claim 7, wherein the first fluidic interconnection is disposed below the horizontally oriented electrical interface, and the horizontally oriented electrical interface is disposed below the second fluidic interconnect septum.

10. The fluid supply cartridge of claim 6, wherein the horizontally oriented electrical interface is an integrated part of the digital fluid level sensor.

11. A fluid supply cartridge horizontally insertable into a fluid-ejection device, comprising:

a housing;

a supply of fluid within the housing;

a digital fluid level sensor within the housing and in contact with the fluid to measure a level of the fluid within the housing; and a horizontal interface at an end of the housing to connect the fluid supply cartridge to a fluid-ejection device, comprising:

a fluid interconnect septum to horizontally fluidically interconnect the supply of fluid to the fluid-ejection device; and a horizontally oriented electrical interface to horizontally conductively connect the digital fluid level sensor to a corresponding electrical interface of the fluid-ejection device, wherein the horizontally oriented electrical interface is a connector into which a corresponding circuit board of the corresponding electrical interface of the fluid-ejection device is insertable.

12. The fluid supply cartridge of claim 11, wherein the fluid interconnect septum is a first fluidic interconnect septum to supply the fluid of the fluid supply cartridge to the fluid-ejection device, and wherein the horizontal interface further comprises a second fluidic interconnect septum to return the fluid and air from the fluid-ejection device to the fluid supply cartridge.

13. The fluid supply cartridge of claim 12, wherein the first fluidic interconnection is disposed below the second fluidic interconnect septum, and the second fluidic interconnect septum is disposed below the horizontally oriented electrical interface.

14. The fluid supply cartridge of claim 12, wherein the first fluidic interconnection is disposed below the horizontally oriented electrical interface, and the horizontally oriented electrical interface is disposed below the second fluidic interconnect septum.

15. The fluid supply cartridge of claim 11, wherein the horizontally oriented electrical interface is an integrated part of the digital fluid level sensor.

* * * * *